US011230116B2

(12) United States Patent
Yamaguchi et al.

(10) Patent No.: US 11,230,116 B2
(45) Date of Patent: Jan. 25, 2022

(54) RECORDING APPARATUS, IMAGE PROCESSING APPARATUS, AND RECORDING METHOD

(71) Applicant: CANON KABUSHIKI KAISHA, Tokyo (JP)

(72) Inventors: Hiromitsu Yamaguchi, Yokohama (JP); Yuto Kajiwara, Kawasaki (JP); Fumitaka Goto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/908,480

(22) Filed: Jun. 22, 2020

(65) Prior Publication Data

US 2020/0406630 A1 Dec. 31, 2020

(30) Foreign Application Priority Data

Jun. 27, 2019 (JP) ..... JP2019-120447

(51) Int. Cl.
*B41J 2/21* (2006.01)
*B41J 3/60* (2006.01)

(52) U.S. Cl.
CPC ..... *B41J 2/2103* (2013.01); *B41J 3/60* (2013.01)

(58) Field of Classification Search
CPC ..... B41J 2/2103; B41J 3/60
See application file for complete search history.

(56) References Cited

U.S. PATENT DOCUMENTS

| | | | | |
|---|---|---|---|---|
| 8,777,355 | B2 * | 7/2014 | Kagata | B41J 2/2107 347/14 |
| 2002/0024574 | A1 * | 2/2002 | Uchida | B41J 3/60 347/104 |
| 2005/0030333 | A1 | 2/2005 | Takahashi | |
| 2017/0282540 | A1 | 10/2017 | Ochi | |
| 2018/0147871 | A1 * | 5/2018 | Landa | B05C 19/06 |

* cited by examiner

*Primary Examiner* — Justin Seo
(74) *Attorney, Agent, or Firm* — Canon U.S.A., Inc. I.P. Division

(57) ABSTRACT

A recording apparatus includes a recording unit configured to apply a recording agent to a recording medium, the recording agent developing metallic luster when fixed to the recording medium, a conveyance unit configured to come into contact with the recording medium and convey the recording medium, after an image to be recorded on a side where the amount of the recording agent is smaller is recorded on a first side of the recording medium, an image to be recorded on a side where the amount of the recording agent is greater is recorded on a second side of the recording medium opposite from the first side.

19 Claims, 18 Drawing Sheets

RECORDING APPARATUS, IMAGE PROCESSING APPARATUS, AND RECORDING METHOD

BACKGROUND OF THE INVENTION

Field of the Invention

The present invention relates to a recording apparatus, an image processing apparatus, and a recording method.

Description of the Related Art

Recording apparatuses that can record images on both sides of a recording medium have been known. United States Patent Application Publication No. 2005/0030333 discusses two-sided recording in which after completion of image recording on a front surface of a recording medium, the recording medium is reversed in a conveyance path and is conveyed to under a recording head, and image recording is performed on a back surface of the recording medium. The image recording is performed by applying ink to the recording medium while the recording medium is conveyed by a conveyance unit, such as rollers. In the image recording on the back surface of the recording medium, the recording medium is conveyed while the front surface on which an image has been recorded comes into contact with the conveyance unit.

Metallic ink that contains metal particles and can be recorded on a recording medium by an inkjet recording apparatus has been introduced to the market in recent years. Using metallic ink can give print products metallic luster. United States Patent Application Publication No. 2017/0282540 discusses a printing apparatus using metallic ink containing silver particles.

SUMMARY OF THE INVENTION

Some inks, including metallic ink, have low abrasion resistance. An image in a region recorded using ink having low abrasion resistance tends to be damaged by pressure in comparison with an image in a region recorded using other inks. In view of image quality, this is a matter of concern. In two-sided recording, in a case where image recording using ink having low abrasion resistance is performed first on the front surface of a recording medium, the recorded image may be worn and damaged by coming into contact with the conveyance unit.

The present invention is directed to obtaining recording images having favorable image quality even in a case where ink having low abrasion resistance is used for two-sided recording.

According to an aspect of the present invention, a recording unit configured to apply a recording agent to a recording medium, the recording agent developing metallic luster when fixed to the recording medium, a conveyance unit configured to come into contact with the recording medium and convey the recording medium, an obtaining unit configured to obtain information about an amount of the recording agent to be used in recording an image to be recorded on one side of the recording medium and information about an amount of the recording agent to be used in recording an image to be recorded on the other side of the recording medium opposite from the one side, and a setting unit configured to set, in a case where the amount of the recording agent indicated by the information related to the one side obtained by the obtaining unit is greater than the amount of the recording agent indicated by the information related to the other side obtained by the obtaining unit, recording order so that after the image to be recorded on the other side is recorded on a first side of the recording medium, the image to be recorded on the one side is recorded on a second side of the recording medium opposite from the first side, and in a case where the amount of the recording agent indicated by the information related to the one side is not greater than the amount of the recording agent indicated by the information related to the other side, recording order so that after the image to be recorded on the one side is recorded on the first side, the image to be recorded on the other side is recorded on the second side.

Further features of the present invention will become apparent from the following description of exemplary embodiments with reference to the attached drawings.

DESCRIPTION OF THE EMBODIMENTS

Figure 1:
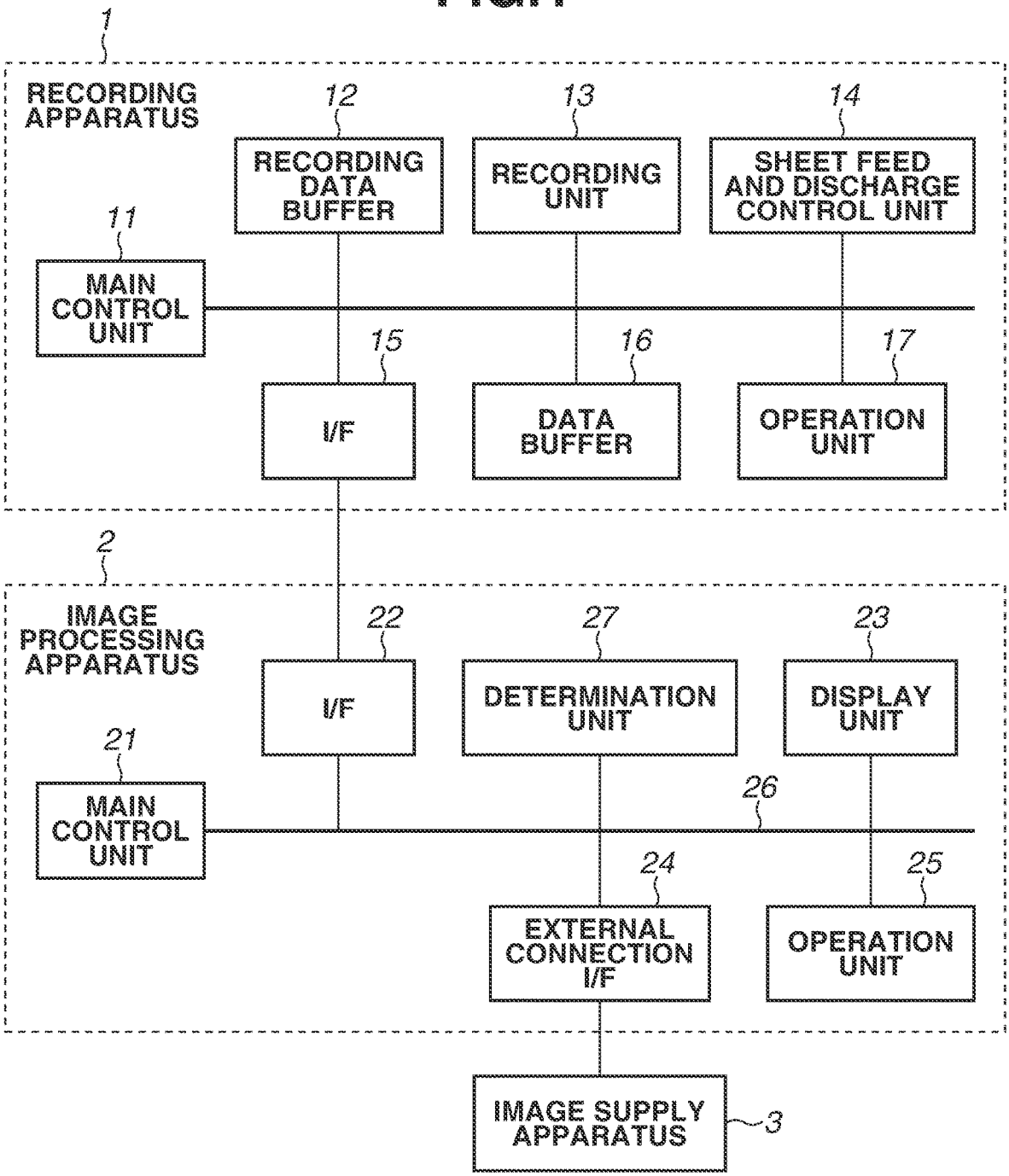
FIG. 1 is a block diagram illustrating a configuration of a recording system according to a first exemplary embodiment.

Exemplary embodiments of the present invention will be described below with reference to the drawings. The following exemplary embodiments are not intended to limit the present invention, and all combinations of features described in the exemplary embodiments are not necessarily indispensable to solving means of the present invention. Similar configurations will be described with the same reference numerals. A relative arrangement and shapes of components described in the exemplary embodiments are merely examples, and are not intended to limit the scope of the present invention only thereto.

<Recording System>

FIG. 1 is a diagram illustrating an example of a recording system according to a first exemplary embodiment. The recording system includes an inkjet recording apparatus (hereinafter, also referred to simply as a recording apparatus) 1, an image processing apparatus 2, and an image supply apparatus 3. The image supply apparatus 3 supplies image data to the image processing apparatus 2. The image processing apparatus 2 generates recording data by predetermined image processing to image data supplied from the image supply apparatus 3, and transmits the generated recording data to the recording apparatus 1. Based on the recording data transmitted from the image processing apparatus 2, the recording apparatus 1 records an image on a recording medium by using ink.

A main control unit 11 of the recording apparatus 1 includes a central processing unit (CPU), a read-only memory (ROM), and a random access memory (RAM), and controls the entire recording apparatus 1 in a centralized manner. For example, the CPU of the main control unit 11 controls a recording head 130 (FIG. 2) and a carriage motor (not illustrated) based on recording data processed using the image processing by the image processing apparatus 2 to record an image. A data buffer 16 temporarily stores the image data received from the image processing apparatus 2 via an interface (I/F) 15. Recording data to be transferred to a recording unit 13 is temporarily stored in a recording data buffer 12 as raster data. An operation unit 17 is a mechanism for user's command operations. Examples of the operation unit 17 include a touch panel and operation buttons. A sheet feed and discharge control unit 14 controls feeding and discharging of a recording medium.

The recording unit 13 includes an inkjet recording head. The recording head includes a plurality of nozzle rows including a plurality of nozzles capable of discharging ink droplets. The recording unit 13 records an image on a recording medium by discharging ink from the recording nozzles based on the image data stored in the recording data buffer 12. In the present exemplary embodiment, a description will be given of a case where the recording head includes a total of four nozzle rows which are for cyan (C), magenta (M), and yellow (Y), three color inks and a metallic (Me) ink as an example.

The Me ink in the present exemplary embodiment contains silver particles. Since a melting point of metal particles depends on a type of the substance and the particle size, the melting point is lowered with decrease in the particle diameter. Small silver particles contained in the Me ink has a particle diameter of around several to several hundreds of nanometers. After the silver particles are applied on a recording surface of a recording medium, a dispersion state of the silver particles are lost as the moisture decreases, and the silver particles fuse together to form a fused sliver film. By the formation of the fused silver film on the recording medium, a lustered recording image is formed.

Other than recording data supplied from the image processing apparatus 2, the recording apparatus 1 can also directly receive image data stored in a storage medium, such as a memory card or image data from a digital camera, and record the received image data.

A main control unit 21 of the image processing apparatus 2 performs various types of processing on image data supplied from the image supply apparatus 3 to generate image data recordable by the recording apparatus 1. The main control unit 21 includes a CPU, a ROM, and a RAM. An I/F 22 exchanges data signals with the recording apparatus 1. An external connection I/F 24 transmits and receives image data and the like to/from the externally-connected image supply apparatus 3. A display unit 23 displays various types of information to the user. An example of the display unit 23 is a liquid crystal display (LCD). An operation unit 25 is a mechanism for user's command operations. Examples of the operation unit 25 include a keyboard and a mouse. A determination unit 27 determines whether an image to be recorded includes Me image data.

In the present exemplary embodiment, the image processing apparatus 2 is configured outside the recording apparatus 1 as an apparatus separate from the recording apparatus 1. However, for example, the recording apparatus 1 may include the configuration of the image processing apparatus 2. In such a case, the recording apparatus 1 may include two main control units and two operation units, or one main control unit and one operation unit. The image supply apparatus 3 may include the functions of the image processing apparatus 2.

<Recording Unit of Recording Apparatus>

Figure 2:
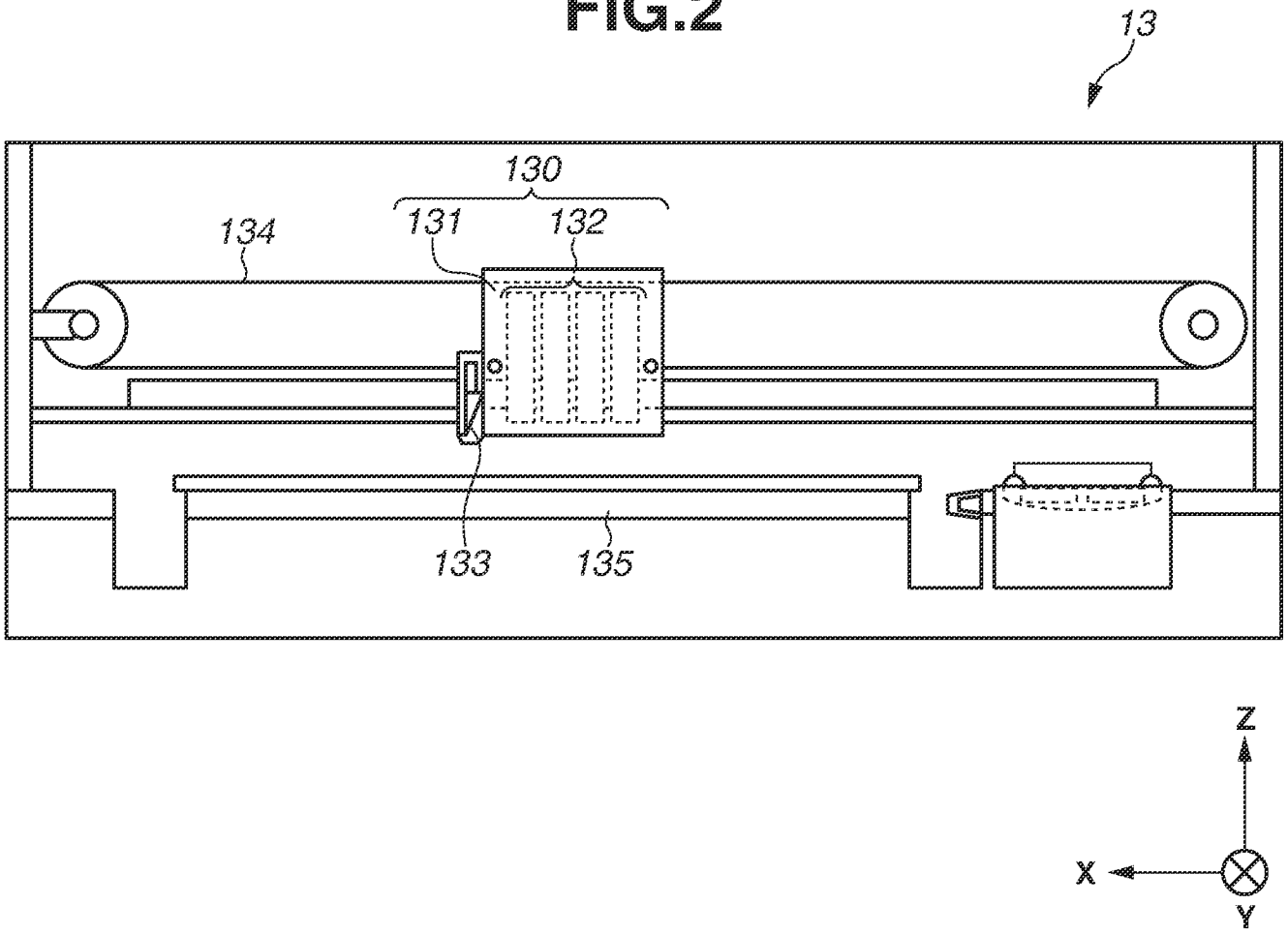
FIG. 2 is a diagram illustrating a configuration of a recording unit of a recording apparatus according to the first exemplary embodiment.

FIG. 2 is a diagram illustrating the recording head 130 included in the recording unit 13 according to the present exemplary embodiment. The recording head 130 includes a carriage 131, nozzle rows 132, and an optical sensor 133. The carriage 131 on which the nozzle rows 132 having four nozzle lows and the optical sensor 133 are mounted can be driven to reciprocate along an X direction (main scanning direction) indicated in FIG. 2 by a force transmitted from the carriage motor via a belt 134. While the carriage 131 relatively moves in the X direction with respect to a recording medium, the nozzles in the nozzle rows 132 discharge color ink in the direction of gravity (−Z direction in the diagram) based on recording data. Thus, an image corresponding to one main scan is recorded on the recording medium on a platen 135. When one main scan is completed, the recording medium is conveyed along a conveyance direction (−Y direction in the diagram) by a distance corresponding to a width equivalent to one main scan. Such a main scan and a conveyance operation are alternately repeated, whereby an image is gradually formed on the recording medium. The optical sensor 133 determines whether there is a recording medium on the platen 135 by performing a detection operation while moving with the carriage 131.

<Conveyance Unit of Recording Apparatus>

Figure 3:
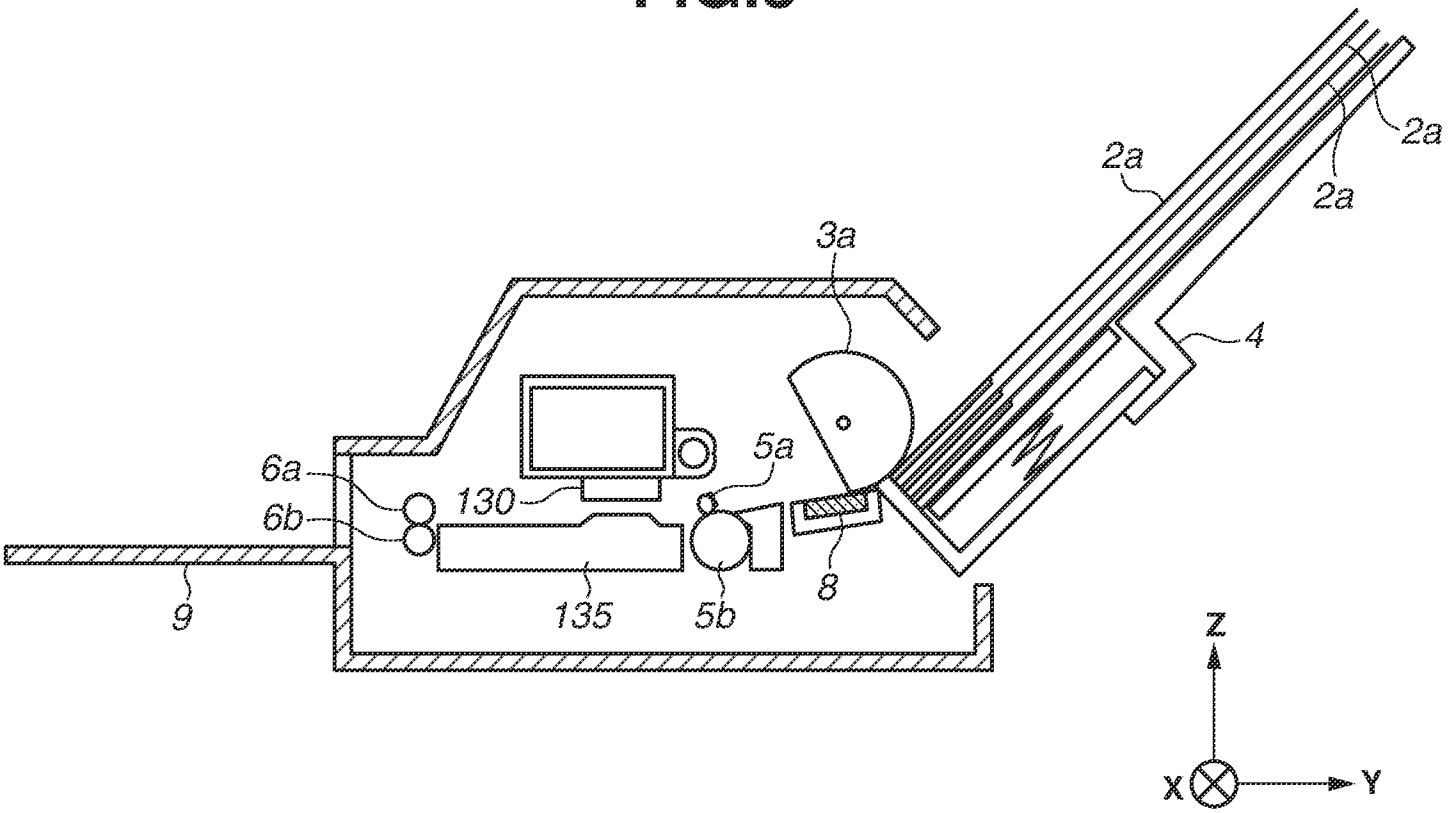
FIG. 3 is a diagram illustrating a configuration of a conveyance unit of the recording apparatus according to the first exemplary embodiment.

FIG. 3 is a sectional view of the recording apparatus 1 according to the present exemplary embodiment, seen in the X direction. A movement of a recording medium controlled by the sheet feed and discharge control unit 14 will be described with reference to FIG. 3. The recording apparatus 1 illustrated in FIG. 3 is a recording apparatus that performs two-sided printing in which the user manually reverses the recording medium. A leading end portion of a recording medium 2*a* placed on a feed tray 4 is pulled out by a sheet feed roller 3*a*, and the recording medium 2*a* is conveyed in the −Y direction. To prevent a plurality of recording media 2*a* from being conveyed, a feed pad 8 is located at a position opposite the sheet feed roller 3*a*. When the leading end of the recording medium 2*a* reaches registration rollers 5*a* and 5*b* disposed upstream of the recording head 130 in the conveyance direction, the leading end of the recording medium 2*a* is abutted against a nip portion between the registration rollers 5*a* and 5*b* by the sheet feed roller 3*a*. The abutting corrects skew of the recording medium 2*a*, whereby the leading end of the recording medium 2*a* is aligned with respect to the recording head 130. After completion of the alignment, the recording medium 2*a* is conveyed to a position opposite the recording head 130 by the registration rollers 5*a* and 5*b*. Ink is discharged to a surface of the recording medium 2*a* opposed to the recording head 130, whereby an image is recorded. The recording head 130 discharges ink during scanning in the X direction, and after completion of the recording, the recording medium 2*a* is conveyed by the registration rollers 5*a* and 5*b* so that the next recording region is opposed to the recording head 130. The recording medium 2*a* on which an image is recorded is then discharged to a discharge tray 9 by sheet discharge rollers 6*a* and 6*b*. Then, image recording on a front surface that is a first side of the recording medium 2*a* is completed. After completion of the image recording on the front surface, the user reverses the recording media 2*a* and sets the recording media 2*a* on the feed tray 4 again with a back surface that is a second side up. Image recording is performed on the back surface by similar operations to the foregoing operations for the image recording on the front surface, and the recording medium 2*a* is discharged to the discharge tray 9. Two-sided recording is performed by the above-described operations. In the present exemplary embodiment, the registration rollers 5*a* and 5*b* and the sheet discharge rollers 6*a* and 6*b* each include a plurality of rollers arranged in the X direction across the width of the recording medium 2*a*.

Figure 12:
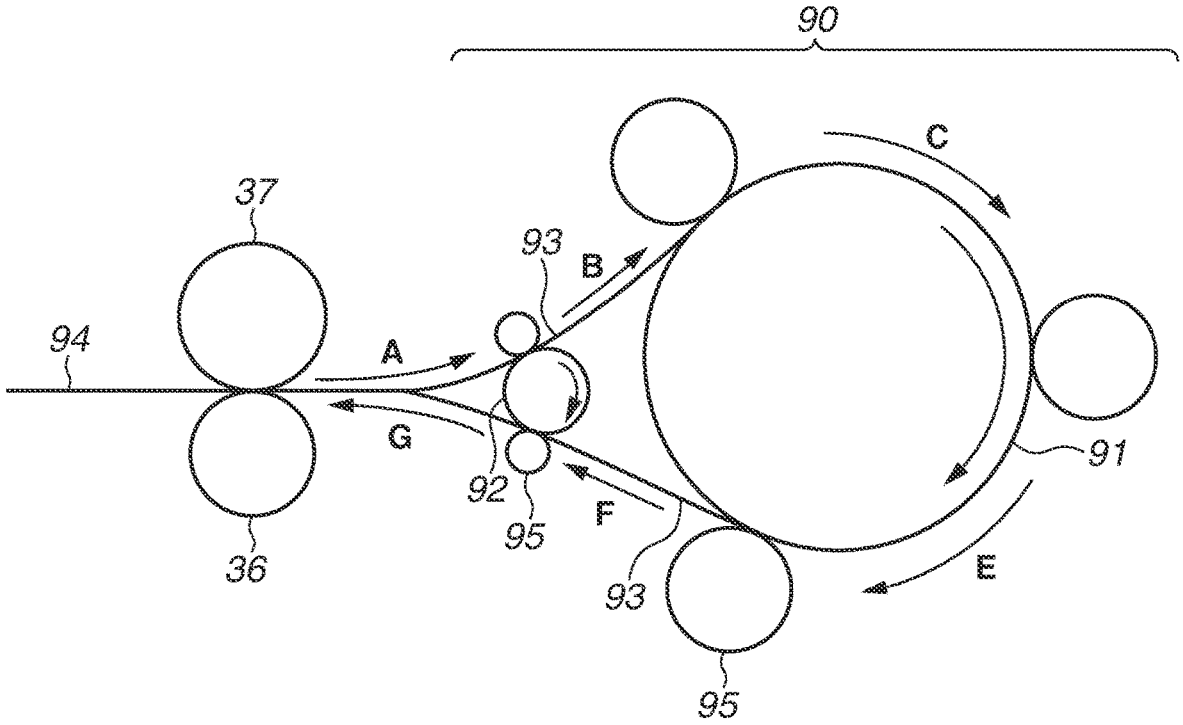
FIG. 12 is a diagram illustrating a configuration of an automatic two-sided recording unit of an inkjet recording apparatus according to the first exemplary embodiment.

As an alternation of the recording apparatus 1 that performs manual two-sided recording in which the user reverses the recording medium and sets the recording medium on the feed tray 4 again, the recording apparatus 1 may be an apparatus that performs automatic two-sided recording by automatically reversing the recording medium. FIG. 12 illustrates an example of an automatic reversing unit (automatic two-sided recording unit) for automatically reversing a recording medium, applicable to the recording apparatus 1. The automatic reversing unit includes a feeding conveyance path 94, a conveyance roller 36, and a reversing unit 90 located behind the recording apparatus 1. The reversing unit 90 includes sheet holding rollers 95, a reversing small roller 92, a looped reversing conveyance path 93, and a reversing large roller 91. The conveyance roller 36 can be driven by a motor to rotate in forward and reverse directions. An image is recorded on one side of the recording medium 2*a* fed from the feed tray 4 while the recording medium 2*a* is conveyed by the conveyance roller 36 rotating in the forward direction. The conveyance roller 36 is then rotated in the reverse direction to convey the recording medium 2*a* in the feeding conveyance path 94 to the reversing conveyance path 93. After reversing of the recording medium 2*a*, the recording head 130 records an image on the other side of the recording medium 2*a*. As illustrated in FIG. 12, the recording medium 2*a* is reversed through the reversing conveyance path 93 in directions indicated by arrows A, B, C, E, F, and G in this order.

<Recording Head>

Figure 4:
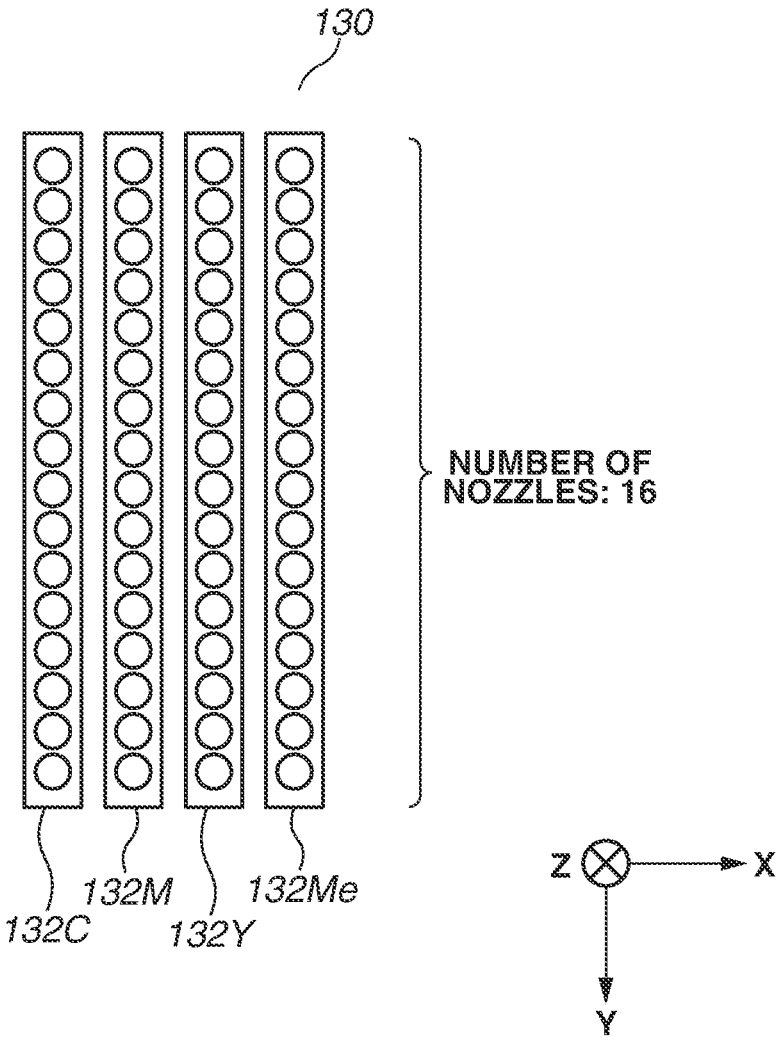
FIG. 4 is a diagram illustrating a configuration of nozzle rows in a recording head according to the first exemplary embodiment.

FIG. 4 is a diagram illustrating a layout of the nozzle rows 132 when the recording head 130 is seen from the bottom of the recording apparatus 1 (in the Z direction). The recording head 130 includes the nozzle rows 132 including four nozzle rows. Specifically, a nozzle row 132C corresponding to C ink, a nozzle row 132M corresponding to M ink, a nozzle row 132Y corresponding to Y ink, and a nozzle row 132Me corresponding to Me ink are disposed at different positions in the X direction. The C ink is discharged from the nozzles in the nozzle row 132C, the M ink from the nozzles in the nozzle row 132M, the Y ink from the nozzles in the nozzle row 132Y, and the Me ink from the nozzles in the nozzle row 132Me. In each nozzle row 132, a plurality of nozzles for discharging ink droplets is arranged at a predetermined pitch along the Y direction. In FIG. 4, each nozzle row 132 includes 16 nozzles arranged at a pitch of 1200 dpi.

<Image Data>

Figure 5A:
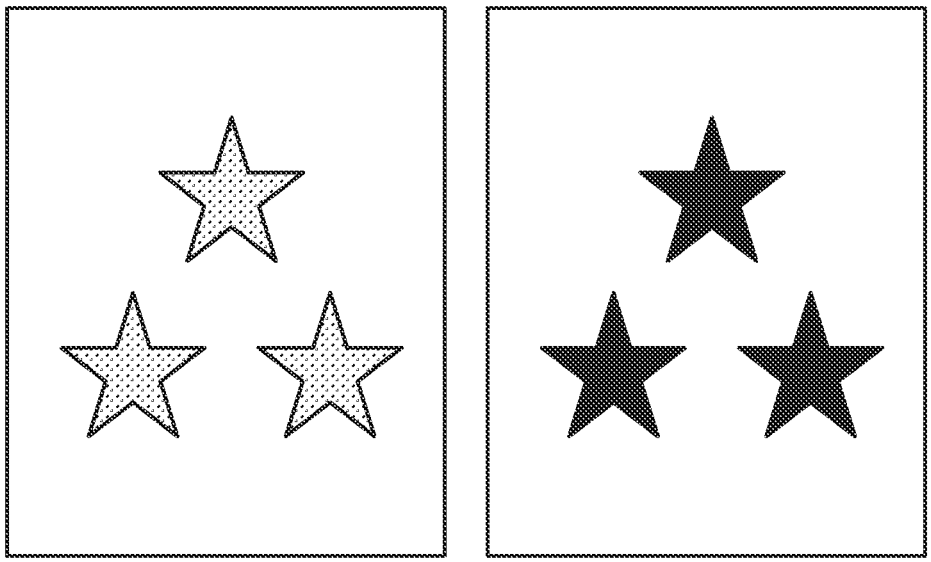
FIGS. 5A and 5B are diagrams illustrating an example of image data used in the first exemplary embodiment.
Figure 5B:
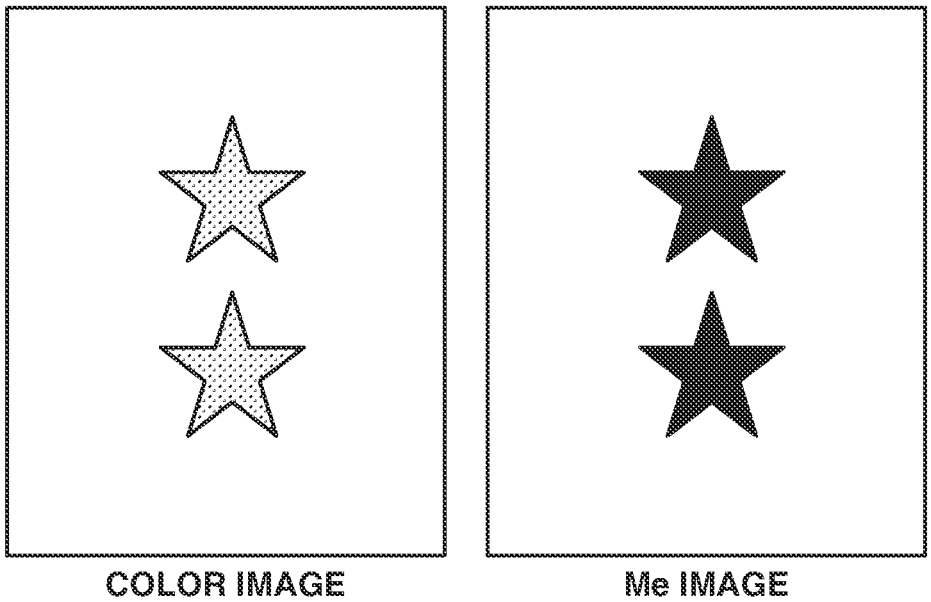

Image data used in the present exemplary embodiment will be described below with reference to FIGS. 5A and 5B. FIGS. 5A and 5B are diagrams illustrating examples of image data that is transmitted from the image supply apparatus 3 to the image processing apparatus 2. The image data illustrated in FIG. 5A is first image data for image recording on one side (page) of a recording medium 2*a*. The image data illustrated in FIG. 5B is second image data for image recording on the other side (page). Image data for one page refers to data for recording an image on one side of the recording medium 2*a*. If, for example, two pages of images are reduced in size and recorded together on one page, image data for one page refers to the combined image data of the two pages of images.

In the present exemplary embodiment, the image processing apparatus 2 receives two types of image data from the image supply apparatus 3. Specifically, as illustrated in FIGS. 5A and 5B, the two types of image data include image data intended for the C, M, and Y, three color inks (hereinafter, referred to as color image data) and image data intended for the Me ink (hereinafter, referred to as Me image data). In the color image data, each pixel has a plurality of color component values for expressing a standardized color space such as the standard Red Green Blue (sRGB) color space. The Me image data is grayscale image data having the same size as the size of the color image data. Among regions recorded by using the color image data and the Me image data, overlapping regions which are three star-shaped regions in a case illustrated in If. 5A are expressed in Me color that is color with metallic luster. In the following description, in color image data, each pixel has values in three channels, specifically, 8-bit values in R, G, and B channels. In Me image data, each pixel has an 8-bit value.

<Recording Data Generation Processing>

Figure 6:
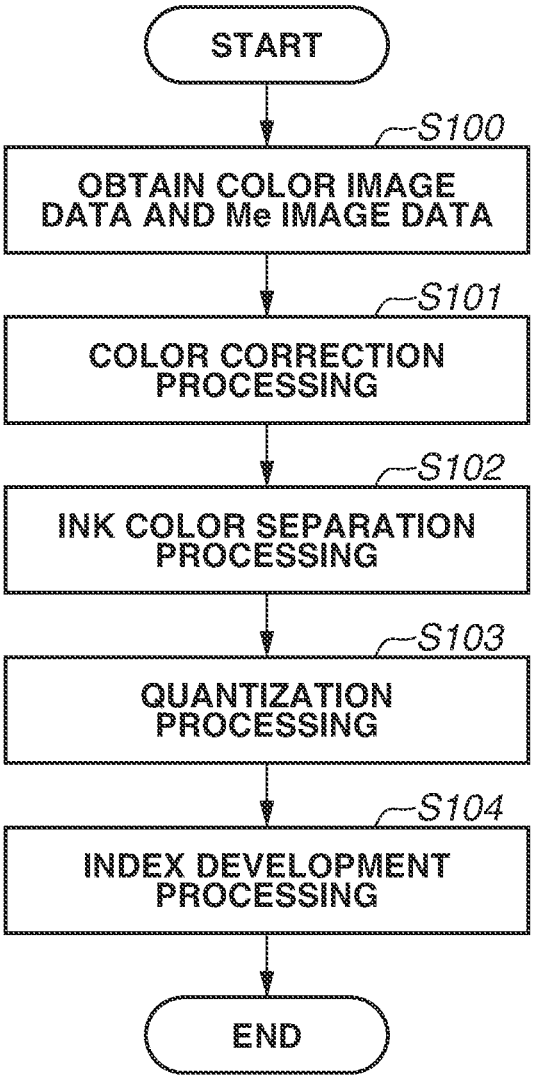
FIG. 6 is a flowchart illustrating recording data generation processing according to the first exemplary embodiment.

FIG. 6 is a flowchart illustrating processing for generating recording data based on image data (referred to as recording data generation processing) according to the present exemplary embodiment. The recording data generation processing is performed by the main control unit 21 of the image processing apparatus 2. The CPU included in the main control unit 21 of the image processing apparatus 2 loads a program stored in the ROM into the RAM and executes the loaded program. Thus, a processing procedure of FIG. 6 is performed. Alternatively, the functions of some or all of the processing procedure in FIG. 6 may be implemented by hardware such as an application specific integrated circuit (ASIC) and an electronic circuit.

In step S100, the main control unit 21 obtains color image data and Me image data transmitted from the image supply apparatus 3.

In step S101, the main control unit 21 performs processing for converting the color image data obtained in step S100 into image data corresponding to the color reproduction gamut of the recording apparatus 1 (referred to as color correction processing). For example, in step S101, image data where each pixel has 8-bit values in the R, G, and B channels is converted into image data where each pixel has 12-bit values in R', G', and B' channels. In the conversion in step S101, conventional techniques, such as matrix operation processing may be used or consulting a three-dimensional lookup table (3D LUT) stored in a ROM in advance is performed. The recording apparatus 1 does not apply the color conversion processing in step S101 to the Me image data obtained in step S100 according to determination that the Me image data corresponds to an 8-bit grayscale image.

In step S102, the main control unit 21 performs processing for separating the image data derived in step S101 into pieces of image data for the respective ink colors (referred to as ink color separation processing). For example, in step S102, the image data where each pixel has 12-bit values in the R', G', and B' channels is separated into pieces of image data for the respective ink colors to be used in the recording apparatus 1 (specifically, pieces of 16-bit gradation data for C, M, and Y colors). In step S102, like step S101, conventional techniques such as consulting a 3D LUT stored in a ROM in advance may be used. The recording apparatus 1 does not apply the color separation processing in step S102 to the Me image data obtained in step S100 by determination that the Me image data corresponds to an 8-bit grayscale image.

In step S103, the main control unit 21 converts the gradation data corresponding to each ink into several-bit quantization data by performing predetermined quantization processing on the gradation data. Specifically, a signal value for each ink is converted into a discharge level that defines the amount of ink to be discharged per unit area. For example, in the case of ternary quantization, the gradation data for each of the C, M, Y, and Me inks is converted into 2-bit data where each pixel has any one of discharge level values 0 to 2.

In step S104, the main control unit 21 performs index development processing based on the discharge levels derived in step S103. An example of the index development processing is processing for developing a pixel in a 600×600 dpi image into a 2×2 pixel bitmap pattern in a 1200×1200 dpi image. Specifically, a bitmap pattern is generated by determining the pixel values of 2×2 pixels in a 1200×1200 dpi image based on values of the discharge levels for the respective ink colors in a pixel in a 600×600 dpi image. The processing in step S104 may be performed by using conventional techniques. For example, dot arrangements corresponding to respective discharge levels may be stored as a table in advance, and dot arrangements corresponding to discharge levels derived in step S103 may be determined by using the table. In step S104, the final dot allocation on the recording medium 2*a* is determined, and binary dot data (also referred to as recording data) corresponding to each of the C, M, Y, and Me inks is generated. First recording data is generated from the first image data. Second recording data is generated from the second image data. For example, in a case where the recording head 130 can allocate dots on the recording medium 2*a* in a resolution of 1200×1200 dpi, whether to allocate a dot is determined with respect to each pixel obtained by dividing the recording medium 2*a* into a 1200×1200 dpi grid.

By the recording data generation processing described above, recording data is generated. The generated recording data is stored in the RAM of the main control unit 21. While each processing of FIG. 6 has been described to be performed by the main control unit 21 of the image processing apparatus 2, the present exemplary embodiment is not limited thereto. Specifically, the main control unit 11 of the recording apparatus 1 may perform all or part of the processing of FIG. 6. A main control unit of the image supply apparatus 3 may perform all or part of the processing of FIG. 6. As described above, the recording data generation processing according to the present exemplary embodiment is performed.

<Recording Operation>

Figure 7:
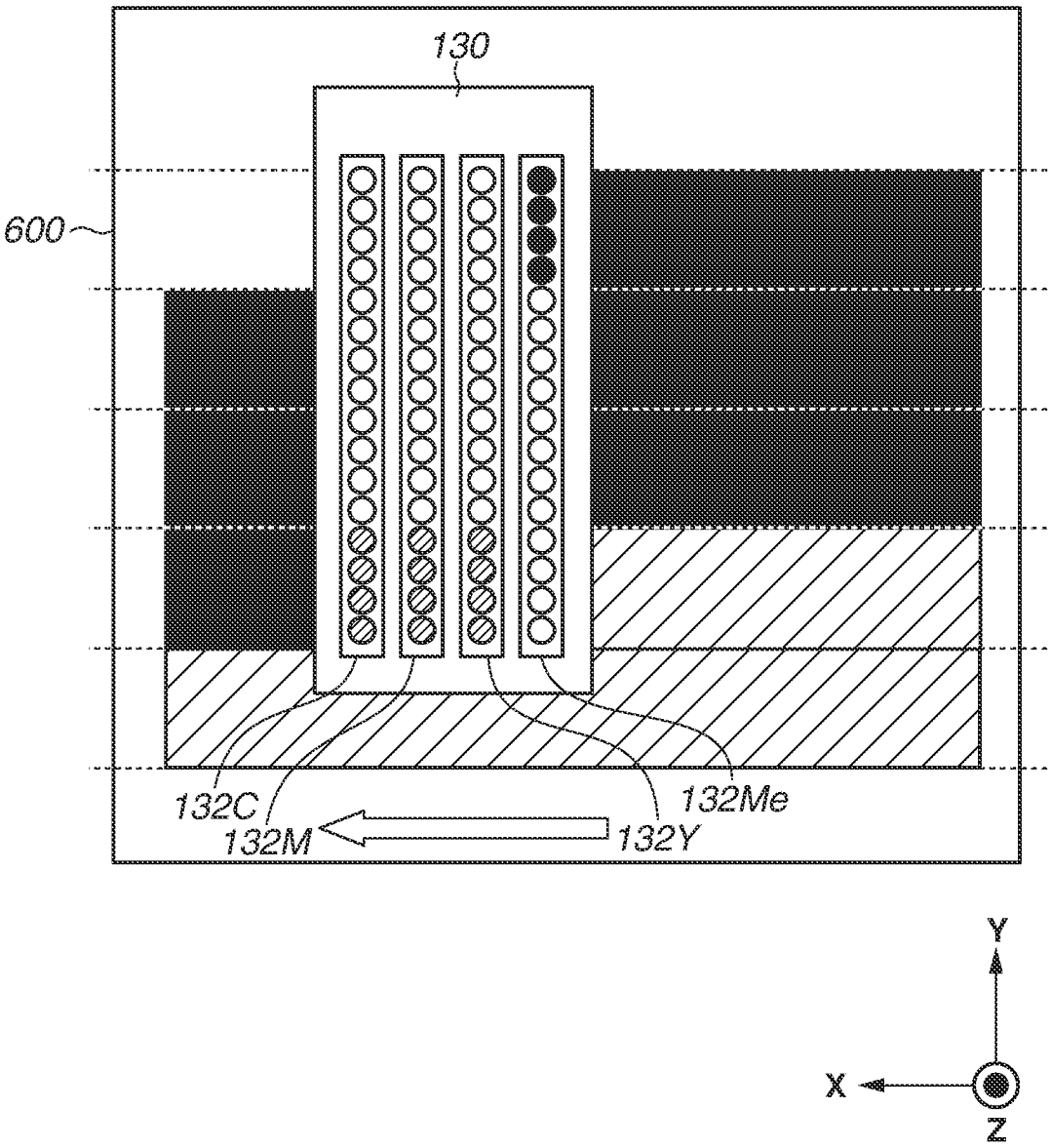
FIG. 7 is a schematic diagram illustrating image recording according to the first exemplary embodiment.

FIG. 7 is a diagram schematically illustrating the layout of the nozzle rows 132 for respective inks in the recording head 130 and processing of a recording operation by the nozzles discharging ink. In the present exemplary embodiment, to express Me color, the color inks and the Me ink are discharged to the same region of the recording medium at different timing. Due consideration may desirably be given to the timing. Specifically, the Me ink is first discharged, and the color inks are then discharged with a time difference of a predetermined value or more. By the time difference, permeation and evaporation of an aqueous solvent included in the Me ink and fusion of silver particles are ensured. Superposing the color inks on such Me ink produces favorable Me color. For ease of description, a case of single-pass (forward-pass or return-pass) image formation will be described below as an example.

When forming an image, the recording head 130 discharges the inks during a scan along the main scanning direction (X direction). After completion of one main scan, the recording medium is conveyed by a predetermined amount along the sub scanning direction (−Y direction). The main scanning by the recording head 130 and the operation for conveying the recording medium are repeated to form an image on the recording medium stepwise. The discharge of the inks and the conveyance operation described above will be referred to collectively as a "recording scan".

In the present exemplary embodiment, among the nozzles in the nozzle row 132Me for discharging the Me ink, the four +Y-side nozzles represented by the filled circles in FIG. 7 are used to form an image. Among the nozzles in each of the nozzle rows 132C, 132M, and 132Y for discharging the C, M, and Y color inks, the four −Y-side nozzles represented by the hatched circles in the diagram are used to form an image. The nozzles on the +Y side of the center of each nozzle row 132 will be referred to as conveyance direction upstream nozzles (also referred to simply as upstream nozzles). The nozzles on the −Y side of the center will be referred to as conveyance direction downstream nozzles (also referred to simply as downstream nozzles). According to the present exemplary embodiment, the recording medium is conveyed by a distance equivalent to four nozzles in the recording operation. This configuration enables discharging of the color inks after discharging of the Me ink.

In FIG. 7, black portions on a recording medium 600 represent regions to which the Me ink is discharged. The hatched portions represent regions to which the color inks are discharged after the recording using the Me ink. The two types of inks are applied to the same regions of the recording medium 600 at different timing by discharging the Me ink from upstream nozzles and discharging the color inks from downstream nozzles.

According to the present exemplary embodiment, as illustrated in FIG. 7, the 4 rows×8 nozzles between the nozzles discharging the Me ink (four upstream nozzles) and the nozzles discharging the color inks (four downstream nozzles) are controlled to not discharge ink. Such a region where neither the Me ink nor the color inks are discharged will be referred to as a "blank nozzle region". The blank nozzle region enables application of the Me ink and the color inks by a sufficient time difference. In the case illustrated in FIG. 7, a time difference equivalent to at least two main scans is provided between the application of the Me ink and the application of the color inks. This configuration can ensure sufficient time for the Me metal applied to the recording medium to dry. As a result, a Me ink layer and a color ink layer can be formed on the recording medium without fail, and Me color can be expressed with excellent luster and color saturation.

The number of nozzles to be used and the conveyance distance are not limited to the foregoing. As another example, in a case where the Me ink is quick-drying ink and the desirable time difference is shorter, the nozzles to discharge the Me ink in the Me-ink nozzle row 132Me may be set to the six nozzles from the uppermost stream side nozzle. The nozzles to discharge color ink in each of the color-ink nozzle rows 132C, 132M, and 132Y may be set to the six nozzles from the lowermost stream side nozzle. In the above-described case, the conveyance distance of the recording medium can be set to as much as six nozzles for improved productivity.

As another example, in a case where the Me ink is slow-drying ink and the desirable time difference is longer, the nozzles to discharge the Me ink in the Me-ink nozzle row 132Me may be set to the three nozzles from the uppermost stream side nozzle. The nozzles to discharge color ink in each of the color-ink nozzle rows 132C, 132M, 132Y may be set to the three nozzles from the lowermost stream side nozzle. In the above-described case, the conveyance distance of the recording medium can be set to as much as three nozzles to increase the time difference.

Alternatively, the nozzles to discharge the Me ink in the Me-ink nozzle row 132Me may be set to the three nozzles from the uppermost stream side nozzle, and the nozzles to discharge color ink in each of the color-ink nozzle rows 132C, 132M, and 132Y may be set to the six nozzles from the lowermost stream side nozzle. In the above-described case, by setting the conveyance distance of the recording medium to as much as three nozzles, the number of scans of the nozzles that can discharge the color inks can be increased, whereby greater amounts of color inks can be discharged to the same region.

<Formation and Surface Fastness of Me Ink Layer>

A mechanism for forming a Me ink layer on a recording medium and forming a color ink layer containing color materials on the Me ink layer to form a color Me image will be described. The recording medium will be described to be glossy paper that is mainly used for photographic printing. The glossy paper that is used in the present exemplary embodiment has a receiving layer having fine pores, and the Me ink has a particle size greater than the size of the fine pores.

Figure 8A:
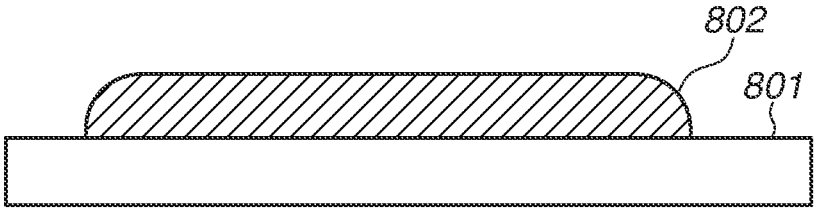
FIGS. 8A, 8B, and 8C are diagrams schematically illustrating metallic ink layer formation and color ink layer formation on a recording medium according to the first exemplary embodiment.

The recording head 130 applies the Me ink containing metal particles to the recording medium. The metal particles in the Me ink applied to the recording medium start to fuse together and the aqueous solvent permeates and evaporates, whereby a Me ink layer is formed on the surface of the recording medium. FIG. 8A is a diagram schematically illustrating a state where a Me ink layer 802 is formed on. As illustrated in FIG. 8A, most of the metal particles included in the Me ink form a layer on a surface of the recording medium 801 without permeating into the recording medium 801. The aqueous solvent in the Me ink permeates into the receiving layer.

Figure 8B:
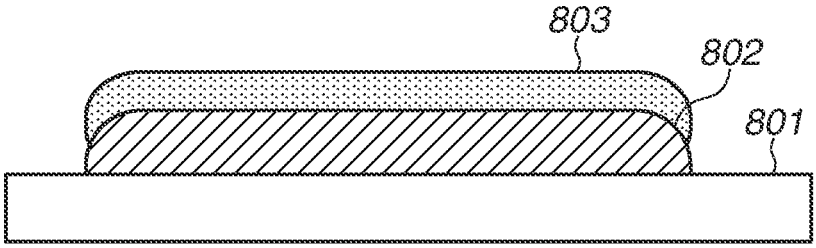

In recording a color Me image, the color inks containing color materials are applied after the Me ink is fixed to the surface by a lapse of sufficient time. In this processing, the color inks form a layer on the formed Me ink layer 802. FIG. 8B is a diagram schematically illustrating a state where the Me ink layer 802 is formed on the recording medium 801 and a color ink layer 803 is formed on the Me ink layer 802. The color ink layer 803 formed on the Me ink layer 802 somewhat permeates into the Me ink layer 802 but is mostly stacked on the Me ink layer 802.

Figure 8C:
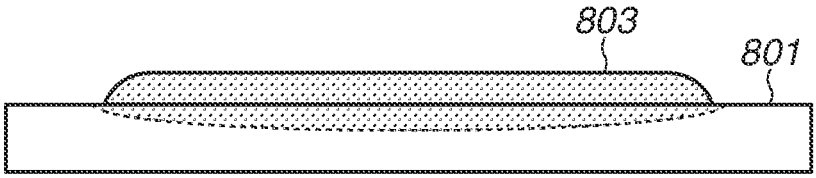

FIG. 8C is a diagram schematically illustrating a state where only the color ink layer 803 is formed on the recording medium 801. As illustrated in FIG. 8C, in a case of using only the color inks, the color ink layer 803 is formed in a relatively smooth thin film. Between the color inks and the Me ink, an aggregation property of the color inks due to bonding between the color materials included in the color ink and an adsorption property of the color inks are higher than an aggregation property of the Me ink due to bonding between the metal particles included in the Me ink and an adsorption property of the metal particles to the recording medium 801. The Me ink layer 802 directly formed on the recording medium 801 thus tends to degrade due to external pressure in comparison with the color ink layer 803 directly formed on the recording medium 801. In other words, the Me ink has abrasion resistance lower than that of the color inks. Specifically, in a case where a force acts on the recording medium 801, reduction in image quality may occur due to damage or partial exfoliation of the Me ink layer 802. During recording, such a reduction in image quality occurs by the Me ink layer 802 coming into contact with conveyance rollers such as the sheet feed roller 3*a*, the registration rollers 5*a* and 5*b*, and the sheet discharge rollers 6*a* and 6*b*. A reduction in image quality tends to occur particularly with increase in the number of times where the image comes into contact with the conveyance rollers. Since abrasion resistance of a case where the Me ink layer 802 is covered with the color ink layer 803 as illustrated in FIG. 8B is higher than abrasion resistance of a case where the Me ink layer 802 is exposed at the surface as illustrated in FIG. 8A, a reduction in image quality due to external pressure and the like is less likely to occur in the case illustrated in FIG. 8B.

The foregoing description is given of fastness of the Me ink and the color inks according to the present exemplary embodiment on a recording medium. The fastness can be increased by, for example, adding a material that significantly improves an adsorption property to a recording medium and adding a material that reduces friction on a surface of ink layers.

In view of the foregoing mechanism, in the present exemplary embodiment, fastness of a color Me image is determined as follows based on dot data corresponding to the Me ink for recording color Me images: in a case where an amount of Me ink to be applied for a page is greater than an amount of Me ink to be applied for the other page, fastness of the page is determined to be lower than that of the other page. In the determination process, the amounts of color inks on each page are not taken into account. In a case where a difference in the amount of Me ink between pages is smaller than a predetermined amount and the amounts of Me ink on the respective pages are substantially the same, fastness may be determined based on other criteria. For example, the greater the sum of areas of regions where the Me ink recording density is higher than a predetermined density in a page, i.e., a page includes many regions where the number of ink dots per unit area is great, it is determined that the page has lower fastness. The determination method is similar to other determination methods described below.

In a case where the numbers of regions where the recording density exceeds the predetermined density are also substantially the same between the pages, fastness of a page may be determined based on an arrangement of regions. For example, a page having regions where recording density exceeds the predetermined density are closely arranged is determined to have fastness lower than fastness of the other page having the regions discretely arranged. Alternatively, in a case where the numbers of the regions are substantially the same between pages, a page having more regions of higher densities may be determined to have low fastness.

Fastness is desirably determined based on evaluation results obtained by preparing print products and contacting and moving a tip of a test member over the print products at a constant pressure in scratch test equipment. It will be understood that the foregoing method is not restrictive, and fastness criteria may be determined based on other measurement methods.

As another determination method, the greater the sum of areas of regions where application density of the Me ink is higher than a predetermined density in a page, i.e., a page having many regions where the number of ink dots per unit area is large, it may be determined that the page has lower fastness. For example, the amount of Me ink per unit area can be calculated by the following method. In the present exemplary embodiment, a region of a predetermined size is equally divided into cells equivalent to the resolution of application of ink dots. With the total number of cells as 100, it is verified by experiments that a Me image having sufficient metallic luster is obtained in a case where the Me ink is applied to more than 50 cells. In other words, metallic luster is obtained in a case where the density of ink dots per unit area in the region of a predetermined size exceeds 50%. The presence of metallic luster means that there is formed a Me ink layer, and it also means that the fastness is low. The number of regions of a predetermined size where the density of Me ink dots per unit area exceeds 50% is then calculated. The greater the total number of such regions, the fastness is determined to be lower. Instead of 50%, the number of regions having ink dots density exceeding 70% may be calculated, for example. The calculation method is not limited to the foregoing, either.

While the amount of Me ink is determined based on the number of dots obtained from dot data, other methods may be used. For example, the size of image regions developing metallic luster may be obtained from image data, and a page having greater size of the regions may be determined to have low fastness.

<Recording Order Setting Processing>

Recording order setting processing illustrated in FIG. 9 will be described. The recording order of image data in the recording apparatus 1 is set by the main control unit 21 of the image processing apparatus 2. The recording order setting processing includes processing for determining fastness of a page for each side surface of a recording medium and controlling the recording order. The fastness is determined based on the amounts of ink dots in the recording data for the Me ink in the first recording data and the second recording data to be recorded on the first side and the second side. For ease of description, in the following processing, the fastness is determined based on the total amount of Me ink, without taking into account the number and arrangement of regions where the density of Me ink per unit area is high. The recording order of recording data at the point in time when the user gives a recording instruction is such that the first recording data is recorded first and then the second recording data is recorded.

In step S200, the display unit 23 of the image processing apparatus 2 displays printing modes. The user specifies a printing mode by using the operation unit 25. The printing modes include a one-sided printing mode and a two-sided printing mode.

In a case where the user inputs a print execution command to the operation unit 25, then in step S201, the main control unit 21 of the image processing apparatus 2 determines whether the printing mode specified in step S200 is the two-sided printing mode. In a case where the specified printing mode is the two-sided printing mode (YES in step S201), the processing proceeds to step S202. In a case where the specified printing mode is the one-sided printing mode (NO in step S201), the processing proceeds to step S220.

In step S202, the main control unit 21 of the image processing apparatus 2 generates recording data by the recording data generation processing illustrated in FIG. 6 based on image data.

In step S203, the main control unit 21 calculates the numbers of dots in the respective pieces of recording data for the Me ink as the amounts of Me ink in the first recording data and the second recording data.

In step S204, the determination unit 27 determines whether the first recording data includes recording data to be recorded by using the Me ink based on the number of Me dots in the first recording data, calculated in step S203. In a case where there is one or more dots, the determination unit 27 determines that there is recording data to be recorded by using the Me ink. In a case where the first recording data is determined to include recording data to be recorded by using the Me ink (YES in step S204), the processing proceeds to step S205. In a case where the first recording data is determined to not include recording data to be recorded by using the Me ink (NO in step S204), the processing proceeds to step S220.

In step S205, the determination unit 27 determines whether the second recording data includes recording data to be recorded by using the Me ink based on the number of Me dots in the second recording data, calculated in step S203. Like step S204, in a case where there is one or more dots, the determination unit 27 determines that there is recording data to be recorded by using the Me ink. In a case where the second recording data is determined to include recording data to be recorded by using the Me ink (YES in step S205), the processing proceeds to step S206. In a case where the second recording data is determined to not include recording data to be recorded by using the Me ink (NO in step S205), the processing proceeds to step S207.

In step S206, the determination unit 27 compares the number of Me ink dots in the first recording data with the number of Me ink dots in the second recording data, both calculated in step S203. In a case where the number of Me ink dots in the first recording data is greater than the number of Me ink dots in the second recording data (YES in step S206), the processing proceeds to step S207. In a case where the number of Me ink dots in the first recording data is less than or equal to the number of Me ink dots in the second recording data (NO in step S206), the processing proceeds to step S220.

In step S207, the main control unit 21 changes recording order. The main control unit 21 sets the reading order of the pieces of recording data so that the second recording data and the first recording data are read from the RAM in this order.

In step S220, the main control unit 21 does not change the recording order. Since the first recording data and the second recording data are already set to be read in this order, the main control unit 21 does not change the reading order of the pieces of recording data from the RAM.

In step S208, the main control unit 21 transmits a print job including the pieces of recording data of which the recording order is set to the data buffer 16 of the recording apparatus 1 via the I/F 22. The data buffer 16 stores the received print job.

In step S205 of the foregoing recording order setting processing, the recording order is changed if the number of Me ink dots in the first recording data is greater than the number of Me ink dots in the second recording data even a little. However, the recording order may be left unchanged if the difference in the number of dots is smaller than a predetermined amount. This can reduce the user's time and effort to rearrange print products after completion of the recording since the recording is performed in the order specified by the user.

<Recording Processing>

Recording processing for performing recording on a recording medium will be described. The recording apparatus 1 performs the recording based on the print job transmitted to the data buffer 16 of the recording apparatus 1 by the processing of FIG. 9. In the present exemplary embodiment, a print job refers to a print instruction set including recording data on at least one side or more. Pieces of recording data in a print job share the same settings about a recording medium and print quality. In the following description, an instruction to print the first recording data and the second recording data, i.e., recording data on two sides will be described. The image data to be recorded is the first and second image data illustrated in FIGS. 5A and 5B.

As described above, in the present exemplary embodiment, the nozzles to be used in the nozzle rows 132 are set to produce a time difference between the application of the Me ink and that of the color inks to the recording medium. In the following description, as described with reference to FIG. 7, the four nozzles from the uppermost stream side nozzle of the nozzle row 132Me for discharging the Me ink and the four nozzles from the lowermost stream side nozzle of each of the nozzle rows 132C, 132M, and 132Y for discharging the color inks are used for recording.

Figure 10:
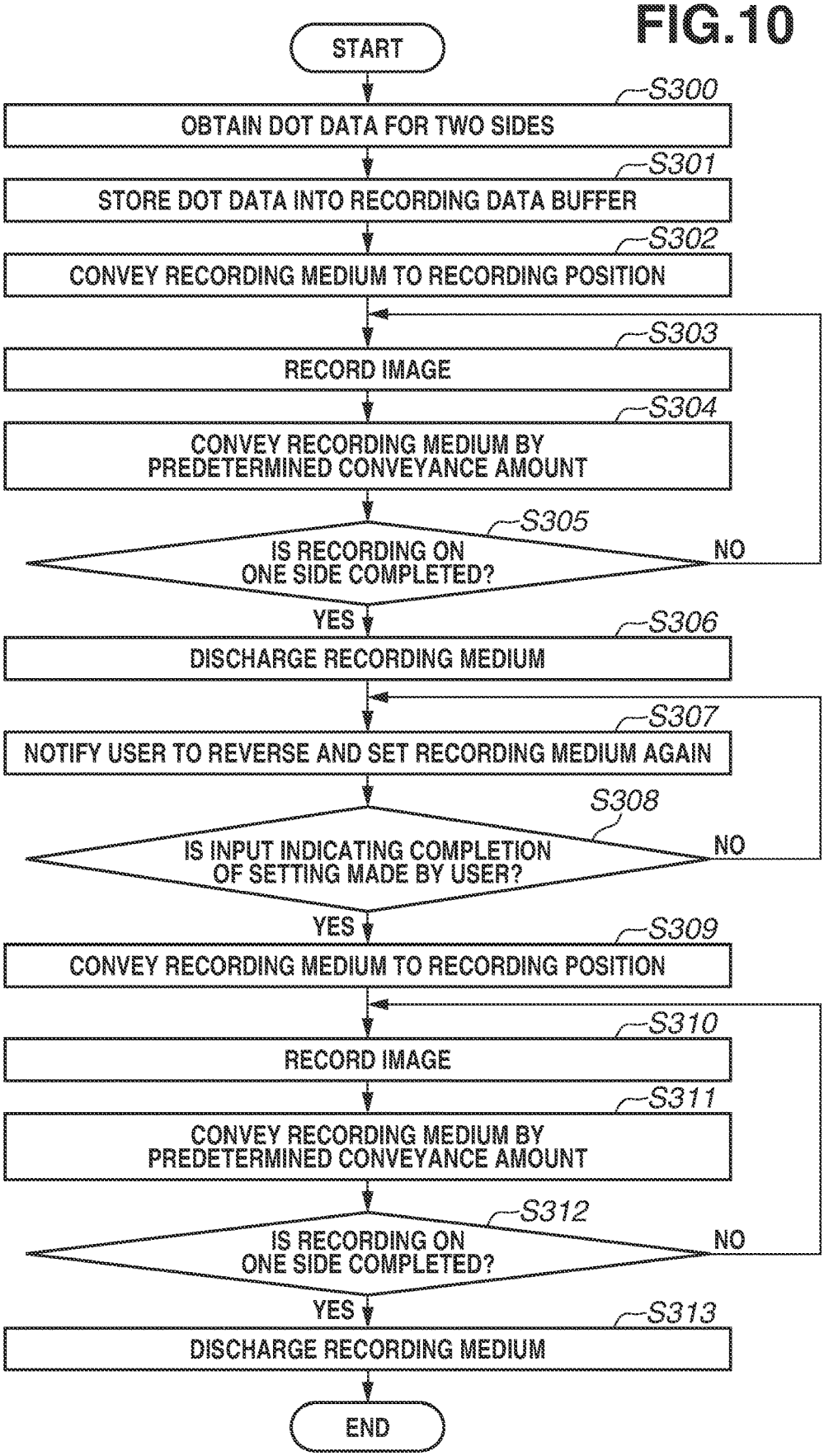
FIG. 10 is a flowchart illustrating recording processing according to the first exemplary embodiment.

FIG. 10 is a flowchart of the recording processing according to the present exemplary embodiment. The recording processing is implemented by the CPU included in the main control unit 11 of the recording apparatus 1 loading a program stored in the ROM into the RAM and executing the loaded program. The recording processing is started when the data buffer 16 receives a print job.

In step S300, the main control unit 11 obtains the first recording data and the second recording data, i.e., the dot data for two sides included in the print job stored in the data buffer 16. The first recording data and the second recording data refer to recording data to be recorded on respective sides of a recording medium.

In step S301, the main control unit 11 stores the dot data corresponding to each ink in the first recording data and the second recording data obtained in step S300 into the recording data buffer 12.

In step S302, the main control unit 11 instructs the sheet feed and discharge control unit 14 to convey a recording medium on the feed tray 4 to a recording position. The sheet feed and discharge control unit 14 conveys a recording medium to the recording position. The recording position refers to a position opposite the recording head 130 and where an image is recorded on the recording medium when the recording head 130 discharges ink.

In step S303, the main control unit 11 reads the dot data on the side to be recorded first that is stored in the recording data buffer 12, and controls the recording head 130 to discharge ink to the recording medium while the recording head 130 performs scanning in the main scanning direction.

In step S304, the main control unit 11 instructs the sheet feed and discharge control unit 14 to convey the recording medium by a predetermined conveyance distance along the sub scanning direction. In the present exemplary embodiment, the predetermined conveyance distance refers to a distance corresponding to the number of nozzles to discharge ink in one recording scan. In the present exemplary embodiment, the predetermined conveyance distance is equivalent to four nozzles.

In step S305, the main control unit 11 determines whether recording on one side is completed. In a case where the recording on one side is not completed (NO in step S305), the processing proceeds to step S303. In step S303, the main control unit 11 controls the recording head 130 to discharge ink. In step S304, the main control unit 11 instructs the sheet feed and discharge control unit 14 to convey the recording medium. In a case where the recording on one side is completed (YES in step S305), the processing proceeds to step S306.

In step S306, since the recording on one side is completed, the main control unit 11 instructs the sheet feed and discharge control unit 14 to discharge the recording medium to the discharge tray 9.

In step S307, the main control unit 11 controls notification from the operation unit 17 or the display unit 23 of the image processing apparatus 2 to notify the user of the completion of the printing on one side and to reverse the discharged recording medium and set the reversed recording medium on the feed tray 4 again.

Receiving the notification, the user reverses the recording medium and sets the reversed recording medium on the feed tray 4. The user then performs an input indicating the completion of the setting to the operation unit 17 or the operation unit 25. In step S308, the main control unit 11 determines whether an input indicating the completion of the setting is performed by the user. in a case where the input is not made (NO in step S308), the processing returns to step S307 to continue the notification. In a case where the input is performed (YES in step S308), the processing proceeds to step S309.

In step S309 to S313, the main control unit 11 performs similar operations to those in steps S302 to S306.

The recording processing is completed in the above-described manner. A drop in image quality can be reduced by recording in the thus set recording order. In the foregoing description, a method for forming an image by applying ink in one scan (single-pass method) is described to be used. The present exemplary embodiment is also applicable to a method for forming an image by applying ink to a unit area smaller than the nozzle arrangement region of the recording head 130 in a plurality of scans (multi-pass method).

In the foregoing case, the nozzle region for the Me ink and the nozzle region for the color inks are set so that the discharge nozzles do not overlap (see FIG. 7). That "the discharge nozzles do not overlap" means that the nozzles discharging ink in the Me-ink nozzle row 132Me and the color-ink nozzle rows 132C, 132M, and 132Y during the same scan of the recording head 130 do not overlap in position in the sub scanning direction. To obtain a sufficient effect from the present exemplary embodiment, the setting of the used nozzle regions to avoid overlapping of discharging nozzles is desirable. However, the present exemplary embodiment is not limited to such a configuration. Images may be recorded by partly-overlapping nozzles as long as high-quality Me color can be expressed by sufficient fusion of metal particles in the Me ink. The nozzles arranged in the overlapping portions may be adjusted to apply smaller amounts of ink.

In the present exemplary embodiment, the recording data included in a print job is two-sided printing data for one recording medium. However, a print job may include recording data for a plurality of recording media. In such a case, the recording order of the recording data can be changed only between the pieces of recording data for each single recording medium. For example, in a case where a print job including first recording data and second recording data for recording images on a recording medium and third recording data and fourth recording data for recording images on another recording medium is obtained, the recording order of the first recording data and the second recording data can be changed. The recording order of the third recording data and the fourth recording data can also be changed. However, the recording order will not be changed between pieces of recording data for recording images on different recording media since such change changes a layout of recording data to be recorded on both sides of a recording medium from a layout of the original recording data.

In the case of recording data for a plurality of recording media, changing the recording order on each recording medium entails the user's time and effort to rearrange the fronts and backs of the recorded products after completion of the recording. In view of this, the total number of Me ink dots to be recorded on the fronts in the original recording order may be compared with the total number of Me ink dots to be recorded on the backs, and the recording order may be set so that recording media is recorded first from the side where the total number of Me ink dots is smaller. For example, a print job for recording first recording data on the front of a first sheet, second recording data on the back of the first sheet, third recording data on the front of a second sheet, and fourth recording data on the back of the second sheet is obtained. In a case where the total number of Me ink dots in the first recording data and the third recording data is greater than the total number of Me ink dots in the second recording data and the fourth recording data, the recording order is changed. In a case where the recording order is changed, the second recording data is recorded on the front of the first sheet, the first recording data is recorded on the back, the fourth recording data is recorded on the front of the second sheet, and the third recording data is recorded on the back.

In a case where the recording order is changed, the user may be notified of the change in the recording order via the display unit 23. The notification from the display unit 23 is controlled by the main control unit 11 or the main control unit 21. The notification can improve user convenience particularly in the case of recording images on a plurality of recording media since which recording medium to be rearranged is notified.

<Specific Example of Recording Order Setting Processing>

Figure 11A:
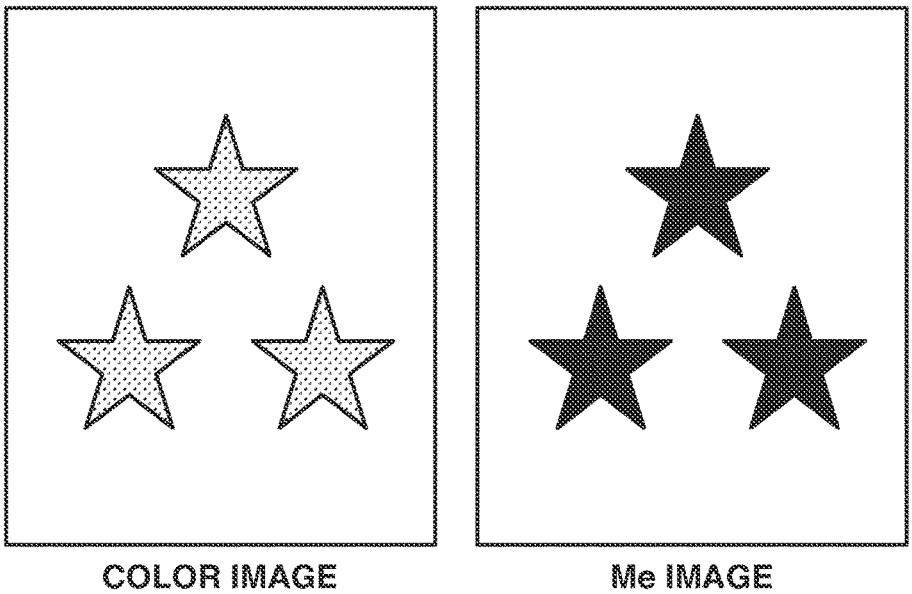
FIGS. 11A and 11B are diagrams illustrating an example of images recorded in the first exemplary embodiment.
Figure 11B:
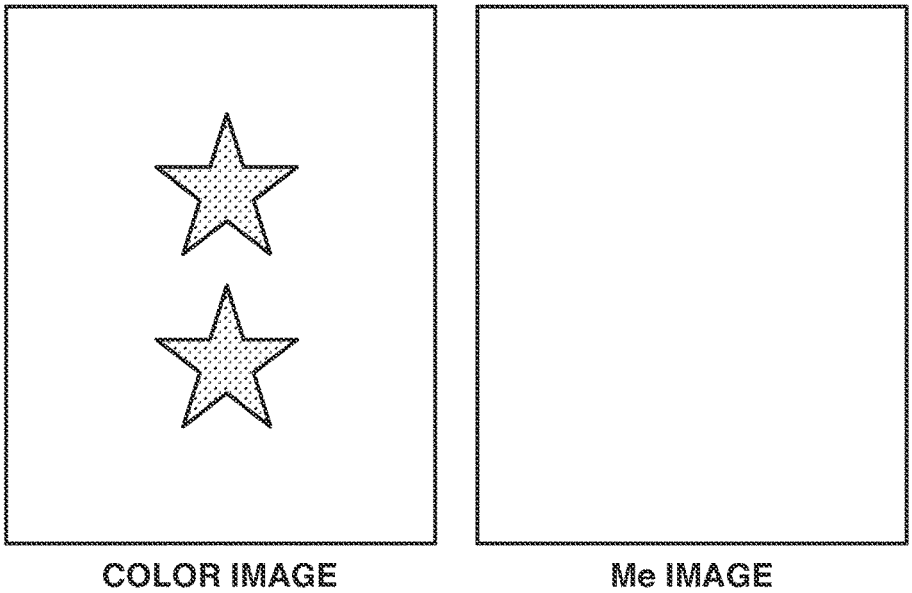

The recording order setting processing will be described below by using a specific example. In this example, images are recorded by using the nozzles in the used nozzle regions illustrated in FIG. 7. FIGS. 11A and 11B illustrate image data on the images to be recorded. FIGS. 11A and 11B illustrate Me image data and color image data to be recorded on a first side and a second side, respectively. The Me image data in the second image data illustrated in FIG. 11B does not include data for applying ink. In other words, the second image data is recorded by using only the color inks. Meanwhile, both the color image data and the Me image data in the first image data illustrated in FIG. 11A include data for applying ink. In other words, a color Me image is to be printed.

The setting of the recording order according to the foregoing specific example will be described in detail below with reference to the flowchart illustrated in FIG. 9.

In step S200, the display unit 23 of the image processing apparatus 2 displays printing modes, and the user specifies a printing mode by using the operation unit 25. Since the images illustrated in FIGS. 11A and 11B are on both sides, the user specifies the two-sided printing mode.

In step S201, the main control unit 21 of the image processing apparatus 2 determines whether the printing mode specified in step S200 is the two-sided printing mode. Since the specified printing mode is the two-sided printing mode (YES in step S201), the processing proceeds to step S202.

In step S202, the main control unit 21 of the image processing apparatus 2 performs the recording data generation processing illustrated in FIG. 6 to generate recording data based on the image data illustrated in FIGS. 11A and 11B.

In step S203, the main control unit 21 calculates the numbers of dots in the respective pieces of Me recording data as the amounts of Me ink in the first recording data and the second recording data.

In step S204, the determination unit 27 determines whether the first recording data includes data to be recorded by using the Me ink, based on the number of dots in the Me recording data of the first recording data, calculated in step S203. In this specific example, the first recording data is determined to include recording data to be recorded by using the Me ink. The processing proceeds to step S205.

In step S205, the determination unit 27 determines whether the second recording data includes data to be recorded by using the Me ink, based on the number of dots in the Me recording data of the second recording data. In this specific example, the second recording data is determined to not include recording data to be recorded by using the Me ink. The processing proceeds to step S207.

In step S207, the main control unit 21 sets the recording order of the first recording data and the second recording data. Specifically, the main control unit 21 sets the reading order so that the second recording data and the first recording data are read from the RAM in this order. The reading order is set by rewriting an address range to be read first with the storage location of the second recording data and rewriting an address range to be read next with the storage location of the first recording data.

In step S208, the main control unit 21 transmits the print job including the recording data of which the recording order is set to the data buffer 16 of the recording apparatus 1 via the I/F 22. The data buffer 16 stores the received print job.

In the foregoing example, the second recording data and the first recording data are set to be recorded in this order. Compared to a case where the image based on the first recording data is recorded first, the number of times where the image comes into contact with the conveyance rollers is one half in the case where the image is recorded later. The reduced number of times reduces the number of times where external pressure acts on the Me ink layer, whereby a reduction in image quality can be reduced.

In the first exemplary embodiment, fastness on each side of a recording medium is determined based on the amount of Me ink, and the recording order is set. However, images recorded by using the Me ink can include a Me image where the Me ink layer is exposed at the surface and a color Me image where a color ink layer covers the Me ink layer. In consideration of the above-described point, in a second exemplary embodiment, the recording order is set so that an image on a side where the Me ink layer is more exposed at the surface is recorded later. A redundant description of portions similar to those in the first exemplary embodiment will be omitted.

<Recording Data Generation Processing>

Figure 13:
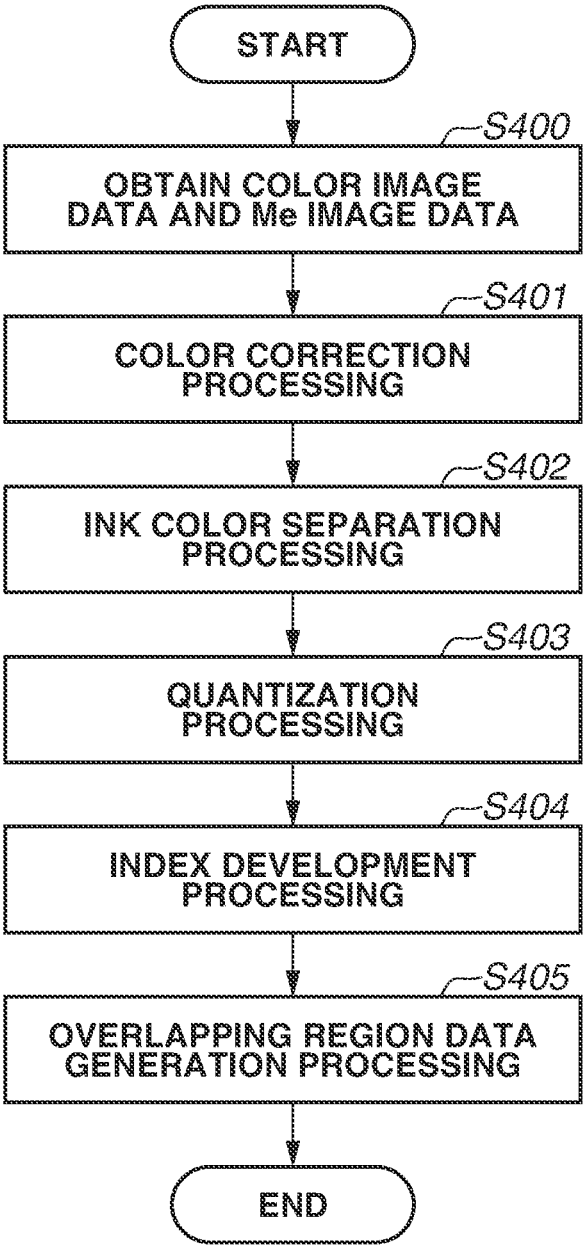
FIG. 13 is a flowchart illustrating recording data generation processing according to a second exemplary embodiment.

FIG. 13 is a flowchart for describing recording data generation processing performed by the main control unit 21 of the image processing apparatus 2 according to the present exemplary embodiment. The CPU included in the main control unit 21 of the image processing apparatus 2 loads a program stored in the ROM into the RAM and executes the loaded program. Each processing of FIG. 13 is thereby performed. Alternatively, the functions of some or all of the steps in FIG. 13 may be implemented by hardware such as an ASIC and an electronic circuit.

In steps S400 to S404, the main control unit 21 performs processing similar to that of steps S100 to S104 in FIG. 6 according to the first exemplary embodiment.

In step S405, the main control unit 21 performs processing for generating data indicating regions where a layer of at least one of the C, M, and Y color inks overlaps the Me ink layer (referred to as overlapping region data generation processing). Specifically, the main control unit 21 determines all pixels where both a Me ink dot and a color ink dot are allocated, by using the dot data corresponding to the Me ink and the dot data corresponding to the C, M, and Y color inks. In step S405, overlapping region data that is binary data, i.e., an overlapping pixel is represented by 1 and a not-overlapping pixel is represented by 0, is generated.

By the recording data generation processing described above, recording data and overlapping region data are generated. While each processing of FIG. 13 is described to be performed by the main control unit 21 of the image processing apparatus 2, the present exemplary embodiment is not limited to such a configuration. Specifically, all or part of the processing of FIG. 13 may be performed by the main control unit 11 of the recording apparatus 1. The above is the description of the recording data generation processing according to the present exemplary embodiment.

<Recording Order Setting Processing>

Figure 14:
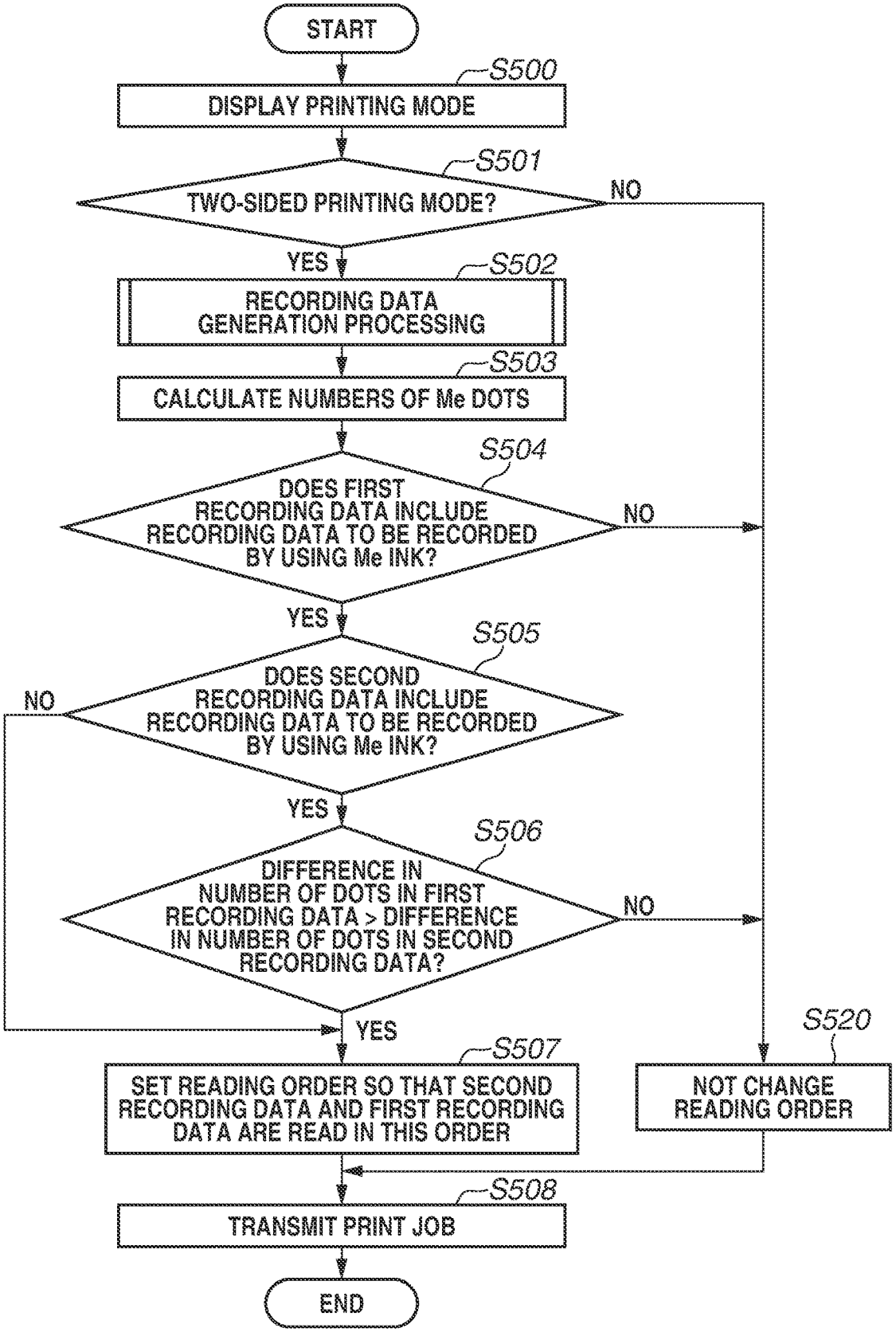
FIG. 14 is a flowchart illustrating recording order setting processing according to the second exemplary embodiment.

Next, recording order setting processing illustrated in FIG. 14 will be described. The recording order of image data in the inkjet recording apparatus 1 is set by the main control unit 21 of the image processing apparatus 2. The recording order setting processing includes processing for determining fastness on each of the first and second sides and controlling the recording order. The fastness is determined based on the amounts of ink dots in the recording data for the Me ink and the recording data for the color inks to be recorded on each side. In the present exemplary embodiment, fastness is determined based on the amount of Me ink to be exposed at the surface.

Figure 9:
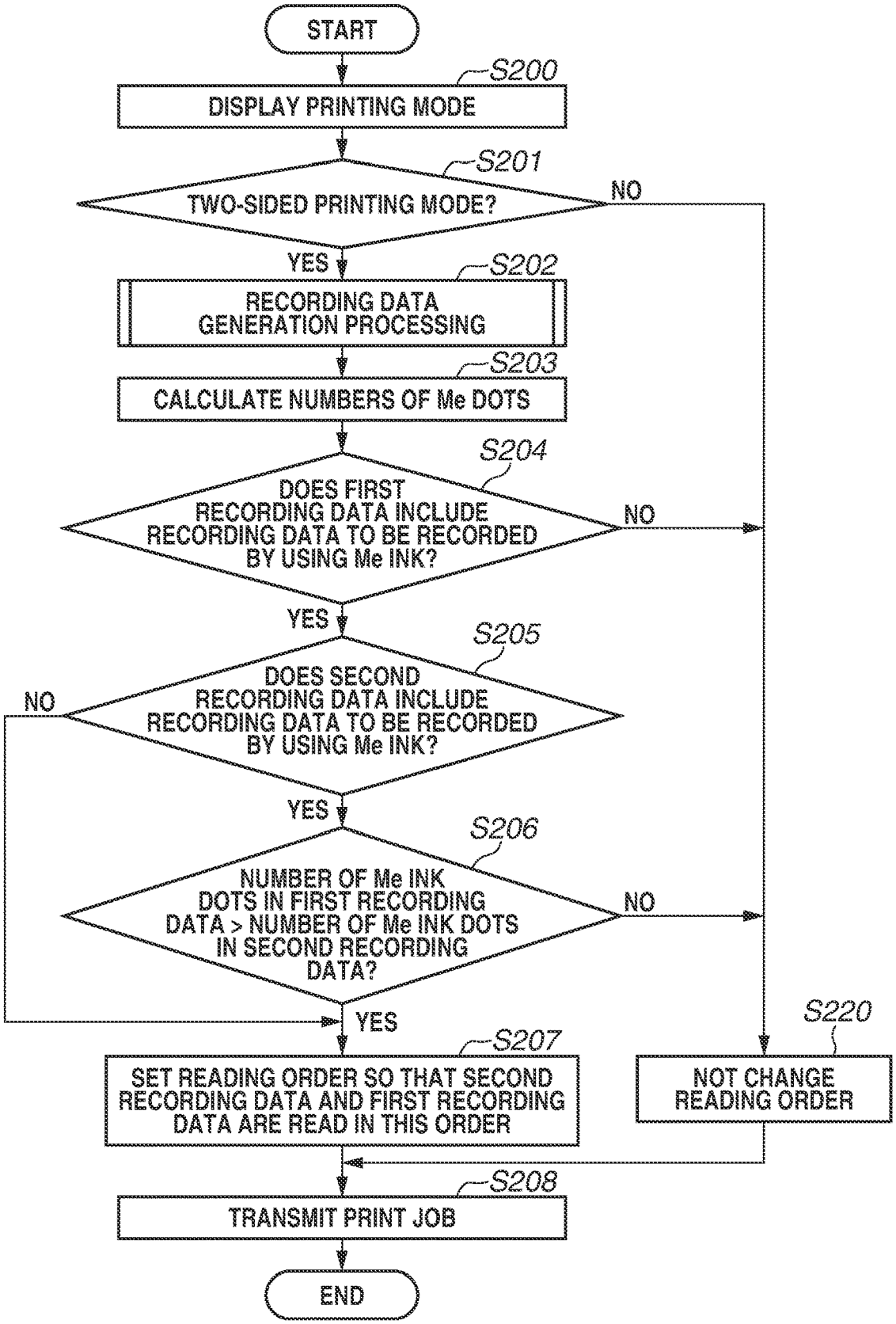
FIG. 9 is a flowchart illustrating recording order setting processing according to the first exemplary embodiment.

In steps S500 and S501, the main control unit 21 of the image processing apparatus 2 performs processing similar to that of steps S200 and S201 in FIG. 9 according to the first exemplary embodiment.

In step S502, the main control unit 21 of the image processing apparatus 2 performs the recording data generation processing illustrated in FIG. 13 to generate recording data and overlapping region data based on the image data.

In steps S503 to S505, the main control unit 21 performs processing similar to that of steps S203 to S205 in FIG. 9 according to the first exemplary embodiment.

In step S506, the determination unit 27 determines fastness based on the overlapping region data generated in step S502 and the numbers of Me ink dots in the first recording data and the second recording data, calculated in step S503. More specifically, for each of the first recording data and the second recording data, the determination unit 27 initially calculates a difference between the number of Me ink dots to be recorded as a color Me image, calculated from the overlapping region data, and the number of Me ink dots calculated from the recording data. An image to be recorded based on the recording data where the calculated difference in the number of dots is greater has an amount of Me ink to be exposed at the recorded surface greater than that of the other. Thus, the image having a greater difference in the number of dots is recorded later. In a case where the difference in the number of dots in the first recording data is greater than the difference in the number of dots in the second recording data (YES in step S506), the processing proceeds to step S507. In a case where the difference in the number of dots in the first recording data is less than or equal to the difference in the number of dots in the second recording data (NO in step S506), the processing proceeds to step S520.

In steps S507, S508, and S520, the main control unit 21 performs processing similar to that of steps S207, S208, and S220 in FIG. 9 according to the first exemplary embodiment.

In step S507, the main control unit 21 changes the recording order. The main control unit 21 sets the reading order of the recording data so that the second recording data and the first recording data are read from the RAM in this order.

In step S520, the main control unit 21 does not change the recording order. Since the first recording data and the second recording data are already set to be read in this order, the main control unit 21 does not change the reading order of the recording data from the RAM.

In step S508, the main control unit 21 transmits a print job including the recording data in which the recording order is set to the data buffer 16 of the recording apparatus 1 via the I/F 22. The data buffer 16 stores the received print job.

As described above, in the present exemplary embodiment, the recording order is set so that recording data including more regions where the Me ink layer having low fastness is exposed at the surface in comparison with the other is printed later. This can reduce the number of times where the image comes into contact with the conveyance rollers, whereby a drop in image quality can be reduced.

In the first exemplary embodiment, glossy paper is described to be used as a recording medium. In a third exemplary embodiment, a description will be given of a case where matte paper is used as well as glossy paper. A redundant description of portions similar to those in the first exemplary embodiment will be omitted.

The fastness of a Me ink layer in a case where matte paper is used as a recording medium, i.e., the fastness of a Me ink layer formed on matte paper will initially be described. The matte paper according to the present exemplary embodiment refers to a recording medium in which the speed of permeation or evaporation of the aqueous solvent in the Me ink into/from the matte paper is equivalent to or shorter than time for the Me ink to cause fusion and form a layer.

<Formation and Abrasion of Me Ink Layer>

Figure 15A:
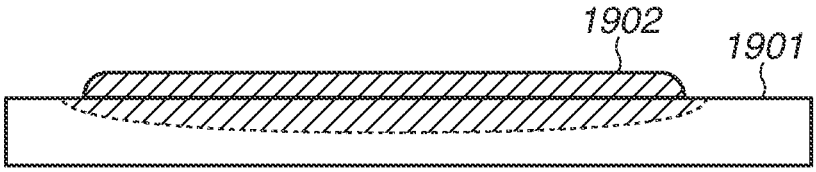
FIGS. 15A, 15B, and 15C are diagrams schematically illustrating metallic ink layer formation and color ink layer formation on a recording medium according to the second exemplary embodiment.

The recording head 130 applies the Me ink to a recording medium. In a case where matte paper is used as the recording medium, the aqueous solvent of the Me ink applied to the recording medium permeates or evaporates faster than in a case where glossy paper is used. The metal particles then contact each other to form a Me ink layer on the surface of and inside the recording medium. FIG. 15A is a diagram schematically illustrating a state where a Me ink layer 1902 is formed on and in a recording medium 1901. As illustrated in FIG. 15A, in the case of matte paper, the Me ink permeates into the recording medium 1901 and forms a layer on the surface of and inside the recording medium 1901.

Figure 15B:
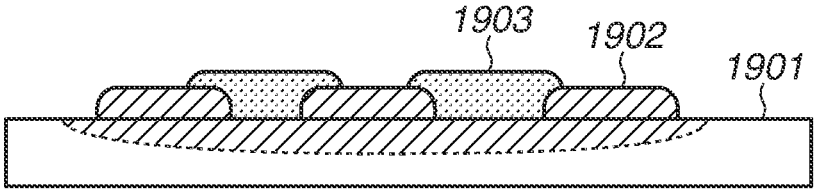

In recording a color Me image, the color inks including color materials are applied after a sufficient time has elapsed and the applied Me ink is fixed. Here, the color inks are formed to overlap the formed Me ink layer 1902 on and in the recording medium 1901. FIG. 15B is a diagram schematically illustrating a state where the Me ink layer 1902 is formed on the surface of and inside the recording medium 1901, and a color ink layer 1903 is formed thereon. The color ink layer 1903 applied onto the Me ink layer 1902 is formed in a state of being fixed to inside the recording medium 1901 as well.

Figure 15C:
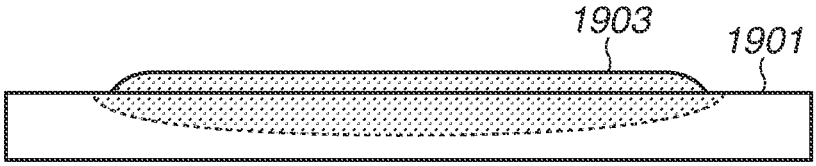

FIG. 15C is a diagram schematically illustrating a state where only the color ink layer 1903 is formed on the recording medium 1901. As illustrated in FIG. 15C, with only the color inks, the color ink layer 1903 is formed on the surface of and inside the recording medium 1901. In particular, the color ink layer 1903 on the surface of the recording medium 1901 is thinner than the Me ink layer 1902 in FIG. 15A. Since the Me ink is fixed not only onto but also inside the recording medium 1901, the color ink layer 1903 on the matte paper is less likely to degrade due to external pressure than a Me ink layer and a color ink layer on glossy paper.

As described above, a glossy recording medium and a matte recording medium have a large difference in adsorptive property, and thus the ink layers are formed in different states. Since the effect of abrasion on the surface of the ink layers depends on the state of formation, the use of matte paper reduces a reduction in image quality due to abrasion of the Me ink layer compared to the use of glossy paper.

<Recording Medium Selection Processing>

Recording medium selection processing according to the present exemplary embodiment will be described with reference to FIG. 16. In the present exemplary embodiment, the recording order setting processing includes different types of processing depending on the type of recording medium selected to be used.

Figure 16:
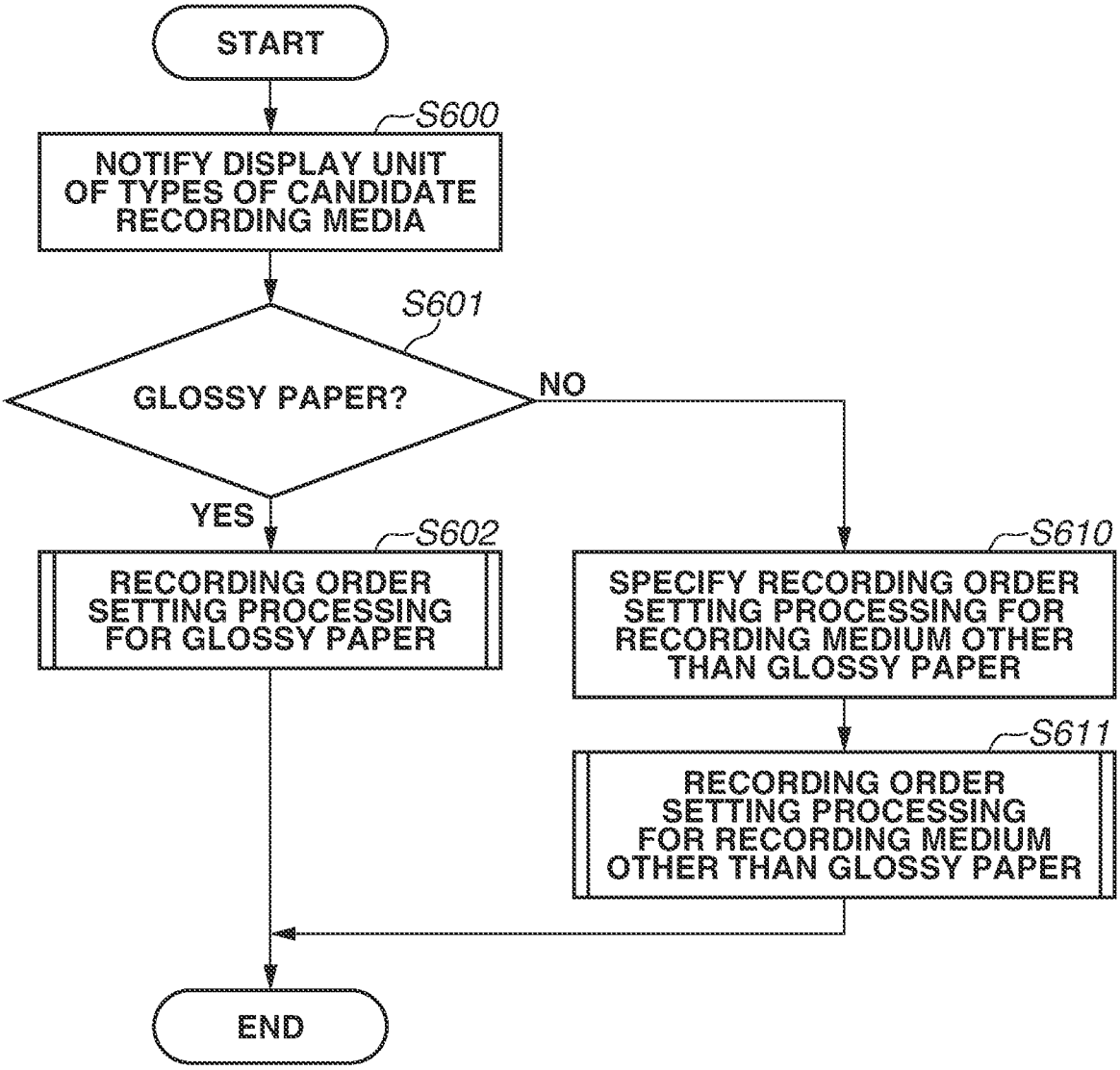
FIG. 16 is a flowchart illustrating recording medium selection processing according to a third exemplary embodiment.

The recording medium selection processing illustrated in FIG. 16 is processing intended to control the recording order of first recording data and second recording data based on the type of recording medium to be used. The recording medium selection processing is performed by the main control unit 21 of the image processing apparatus 2.

In step S600, the main control unit 21 initially notifies the display unit 23 of the image processing apparatus 2 of the types of candidate recording media. The user selects a type of recording medium to be used from among the notified types of recording media by using the operation unit 25.

The main control unit 21 accepts information about the type of recording medium selected by using the operation unit 25. In step S601, the main control unit 21 determines whether the type of recording medium selected is glossy paper. In a case where the type of recording medium selected is glossy paper (YES in step S601), the processing proceeds to step S602. In a case where any other type of recording medium is selected (NO in step S601), the processing proceeds to step S610.

In step S602, the main control unit 21 performs the recording order setting processing based on the processing procedure illustrated in FIG. 9 according to the first exemplary embodiment.

In step S610, the main control unit 21 specifies recording order setting processing for a recording medium other than glossy paper.

Figure 17:
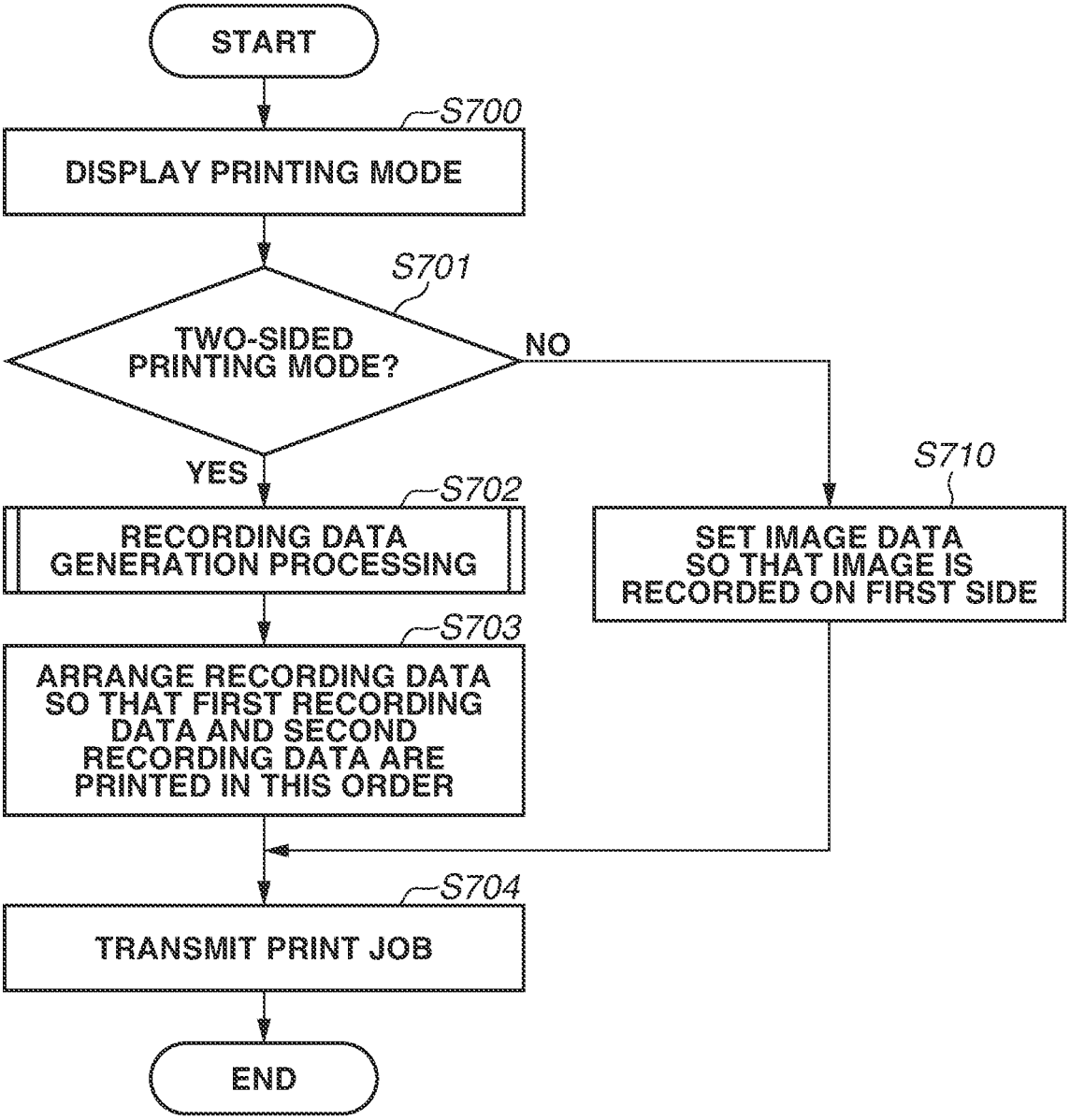
FIG. 17 is a flowchart illustrating recording order setting processing according to the third exemplary embodiment.

In step S611, the main control unit 21 of the image processing apparatus 2 performs the recording order setting processing based on a processing procedure illustrated in FIG. 17.

<Recording Order Setting Processing>

FIG. 17 is a flowchart illustrating the recording order setting processing for a recording medium other than glossy paper in step S610 of FIG. 16. In a case where a recording medium other than glossy paper is selected, a reduction in the image quality is determined to be less likely to occur due to abrasion of the Me ink layer and the recording order is left unchanged.

In steps S700 to S702, the main control unit 21 performs processing similar to that of steps S200 to S202 in FIG. 9 according to the first exemplary embodiment. In step S701, in a case where the selected printing mode is not the two-sided printing mode but the one-sided printing mode (NO in step S701), the processing proceeds to step S710. In step S710, to perform one-sided printing, the main control unit 21 sets the image data so that image recording is performed on the first side.

In step S703, the main control unit 21 sets the recording order. Since the recording order is not changed, the main control unit 21 arranges the pieces of recording data so that the first recording data and the second recording data are printed in this order.

In step S704, the main control unit 21 performs processing similar to that of step S208 in FIG. 9 according to the first exemplary embodiment. The main control unit 21 transmits a print job including the recording data of which the recording order is set, to the data buffer 16 of the recording apparatus 1 via the I/F 22. The data buffer 16 stores the received print job.

As described above, in the present exemplary embodiment, whether to change the recording order is changed based on the type of recording medium to be used for recording. This can reduce a reduction in image quality when a recording medium likely to cause a reduction in image quality due to abrasion of a Me ink layer is used. Since the recording order is left unchanged when a recording medium less likely to cause a reduction in image quality due to abrasion of a Me ink layer is used, user convenience can be prevented from being degraded due to a change in the recording order in printing a plurality of recording media.

In the first to third exemplary embodiments, the amounts of Me ink applied to respective pages are compared by comparing the amounts of Me ink applied to the entire areas of the sides to be recorded. According to a fourth exemplary embodiment, the amounts of Me ink applied to specific regions of the recording media, but not the mounts of Me ink applied to the entire areas, are compared.

In the present exemplary embodiment, the specific regions refer to where a side to be recorded first comes into contact with a sheet feed roller 3*a*, registration roller 5*a* and 5*b*, and discharge rollers 6*a* and 6*b* in printing a side to be printed later. If there is a region or regions where the side to be recorded first comes into contact with other than the foregoing rollers, such a region(s) may also be included in the specific regions.

Figure 18:
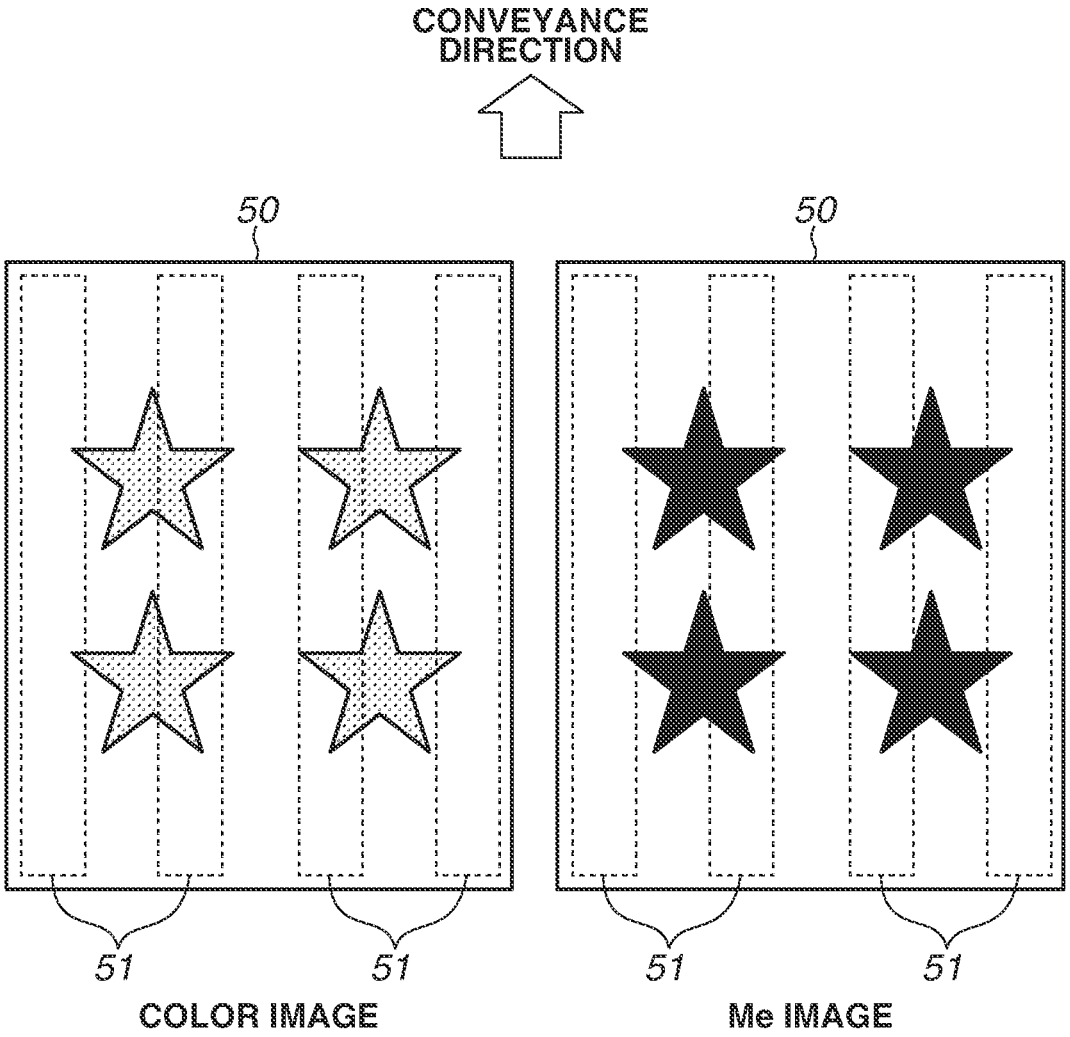
FIG. 18 is a diagram illustrating specific regions according to a fourth exemplary embodiment.

FIG. 18 is a diagram for describing the specific regions. FIG. 18 illustrates a state where a color image and a Me image are recorded on a recording media 50. The recording media 50 are conveyed upward in FIG. 18 during recording. Specific regions 51 which come into contact with the rollers are illustrated in dotted lines. The specific regions 51 are regions where, in a case where an image has been already recorded, a reduction in image quality can occur by abrasion of the Me ink layer coming into contact with the rollers.

In the present exemplary embodiment, the first recording data is compared with the second recording data in terms of the amount of Me ink in the specific regions 51, and the side where the amount of Me ink is smaller is recorded first. Like the second exemplary embodiment, the side with fewer regions where the Me ink layer is exposed at the surface may be recorded first. In a case where the first recording data and the second recording data do not have much difference in the amount of Me ink in the specific regions 51, the recording order may be left unchanged. Leaving the recording order unchanged can reduce the user's time and effort to rearrange pages in order.

OTHER EXEMPLARY EMBODIMENTS

In the foregoing exemplary embodiments, the C, M, and Y, three color inks are described to be used as the color inks. However, the color inks are not limited thereto. Any color ink may be used. Examples include black (K), gray (Gy), light cyan (Lc), and light magenta (Lm) inks. Spot color inks such as red (R), green (G), and blue (B) inks may also be used.

In the foregoing exemplary embodiments, which piece of recording data to be recorded first is determined based on the amount of Me ink forming a Me ink layer. However, the ink to be used as the determination criterion is not limited to the Me ink. An exemplary embodiment of the present invention is applicable with any ink that forms an ink layer vulnerable to external pressure.

The foregoing exemplary embodiments may be combined as appropriate.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

According to an exemplary embodiment of the present invention, a reduction in the image quality of images recorded by using ink having low abrasion resistance can be reduced by recording later a side where the ink having low abrasion resistance is more used, during two-sided recording.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-120447, filed Jun. 27, 2019, which is hereby incorporated by reference herein in its entirety.

What is claimed is:

1. A recording apparatus comprising:

a recording unit configured to apply a recording agent to a recording medium, wherein the recording agent develops metallic luster when fixed to the recording medium and the recording unit is configured to perform recording on both sides of the recording medium;

an obtaining unit configured to obtain information related to one side of the recording medium and indicating an amount of the recording agent to be used in recording an image to be recorded on the one side and to obtain information related to the other side of the recording medium opposite from the one side, wherein the information related to the other side is about an amount of the recording agent to be used in recording an image to be recorded on the other side; and a setting unit configured to set recording order, wherein, in a case where the amount of the recording agent indicated by the obtained information related to the one side is greater than the amount of the recording agent indicated by the obtained information related to the other side and a difference between the amount of the recording agent indicated by the information related to the one side and the amount of the recording agent indicated by the information related to the other side is equal to or larger than a predetermined amount, the setting unit sets the recording order so that, after the image to be recorded on the other side is recorded on a first side of the recording medium, the image to be recorded on the one side is recorded on a second side of the recording medium opposite from the first side, wherein, in the case where the amount of the recording agent indicated by the obtained information related to the one side is not greater than the amount of the recording agent indicated by the information related to the other side and the difference between the amount of the recording agent indicated by the information related to the one side and the amount of the recording agent indicated by the information related to the other side is equal to or larger than the predetermined amount, the setting unit sets the recording order so that, after the image to be recorded on the one side is recorded on the first side, the image to be recorded on the other side is recorded on the second side, and wherein, in a case where the difference between the amount of the recording agent indicated by the information related to the one side and the amount of the recording agent indicated by the information related to the other side is less than the predetermined amount, the setting unit sets the recording order so that, after the image to be recorded on the one side is recorded on the first side, the image to be recorded on the other side is recorded on the second side.

2. The recording apparatus according to claim 1, wherein the information related to the one side and the information related to the other side are information indicating total amounts of the recording agent to be used in recording the image to be recorded on the one side and the image to be recorded on the other side on the recording medium.

3. The recording apparatus according to claim 1, wherein the recording unit is configured to apply a color recording agent including a color material to the recording medium, and wherein the information related to the one side and the information related to the other side are information indicating amounts of the recording agent to be formed in an exposed state at a surface when the image to be recorded on the one side and the image to be recorded on the other side are recorded on the recording medium.

4. The recording apparatus according to claim 1, further comprising a conveyance unit configured to come into contact with the recording medium and convey the recording medium, wherein the information related to the one side and the information related to the other side are information indicating amounts of the recording agent to be applied to a region of the recording medium, and wherein the region of the recording medium comes into contact with the conveyance unit when the recording medium is conveyed by the conveyance unit.

5. The recording apparatus according to claim 1, further comprising a conveyance unit configured to come into contact with the recording medium and convey the recording medium, wherein, of the recording agent to be applied to a region of the recording medium, the information related to the one side and the information related to the other side are information indicating amounts of the recording agent to be formed in an exposed state at a surface when the image to be recorded on the one side and the image to be recorded on the other side are recorded on the recording medium, and wherein the region of the recording medium comes into contact with the conveyance unit when the recording medium is conveyed by the conveyance unit.

6. The recording apparatus according to claim 1, wherein, in the case where the difference between the amount of the recording agent indicated by the information related to the one side and the amount of the recording agent indicated by the information related to the other side is less than the predetermined amount, the setting unit sets the recording order so that an image to be recorded later is recorded later, and wherein the image to be recorded later is to be recorded on the one side where a region of the recording medium having a recording density of the recording agent higher than a predetermined density is larger in size than the other side of the recording medium.

7. The recording apparatus according to claim 1, wherein the recording agent is metallic ink including metal particles.

8. The recording apparatus according to claim 3, wherein the color recording agent is color ink including the color material.

9. The recording apparatus according to claim 1, further comprising an acceptance unit configured to accept input of a type of recording medium, wherein, in a case where the type of recording medium accepted by the acceptance unit is a first type and the amount of the recording agent indicated by the information related to the one side is greater than the amount of the recording agent indicated by the information related to the other side, the setting unit sets the recording order so that, after the image to be recorded on the other side is recorded on the first side of the recording medium, the image to be recorded on the one side is recorded on the second side of the recording medium, wherein, in the case where the type of recording medium accepted by the acceptance unit is the first type and the amount of the recording agent indicated by the information related to the one side is not greater than the amount of the recording agent indicated by the information related to the other side, the setting unit sets the recording order so that, after the image to be recorded on the one side is recorded on the first side of the recording medium, the image to be recorded on the other side is recorded on the second side of the recording medium, and wherein, in a case where the type of recording medium accepted by the acceptance unit is a second type, the setting unit sets the recording order so that, after the image to be recorded on the one side is recorded on the first side of the recording medium, the image to be recorded on the other side is recorded on the second side of the recording medium regardless of the amount of the recording agent indicated by the information related to the one side and the amount of the recording agent indicated by the information related to the other side.

10. The recording apparatus according to claim 1, further comprising:

a storage unit configured to receive, from an external apparatus, data on the image to be recorded on the one side and the image to be recorded on the other side on the recording medium, and to store the data, wherein the received data has recording order; and a notification control unit, wherein, in a case where recording order of the data set by the setting unit is different from the recording order of the data received by the storage unit, the notification control unit causes a notification unit to notify a user that the recording order is changed.

11. An image processing apparatus comprising:

a generating unit configured to generate data on images, wherein the generated data is configured to be used to record the images and to apply a recording agent to a recording medium, and wherein the recording agent develops metallic luster when fixed to the recording medium; and an obtaining unit configured to obtain information indicating an amount of the recording agent to be used in recording an image to be recorded on one side of the recording medium and to obtain information about an amount of the recording agent to be used in recording an image to be recorded on the other side of the recording medium opposite from the one side, wherein, in a case where the amount of the recording agent indicated by the obtained information related to the one side is greater than the amount of the recording agent indicated by the obtained information related to the other side and a difference between the amount of the recording agent indicated by the information related to the one side and the amount of the recording agent indicated by the information related to the other side is equal to or larger than a predetermined amount, the generating unit generates the data so that, after the image to be recorded on the other side is recorded on a first side of the recording medium, the image to be recorded on the one side is recorded on a second side of the recording medium opposite from the first side, and wherein, in the case where the amount of the recording agent indicated by the obtained information related to the one side is not greater than the amount of the recording agent indicated by the information related to the other side and the difference between the amount of the recording agent indicated by the information related to the one side and the amount of the recording agent indicated by the information related to the other side is equal to or larger than the predetermined amount, the generating unit generates the data so that, after the image to be recorded on the one side is recorded on the first side, the image to be recorded on the other side is recorded on the second side.

12. The image processing apparatus according to claim 11, wherein the generated data is configured to be used to apply a color recording agent including a color material to the recording medium, wherein the information related to the one side and the information related to the other side are information indicating amounts of the recording agent to be formed in an exposed state at a surface when the image to be recorded on the one side and the image to be recorded on the other side are recorded on the recording medium, and wherein, in a case where the difference between the amount of the recording agent indicated by the information related to the one side and the amount of the recording agent indicated by the information related to the other side is less than the predetermined amount, the generating unit generates the data so that, after the image to be recorded on the one side is recorded on the first side, the image to be recorded on the other side is recorded on the second side.

13. A recording method for a recording apparatus having a recording unit configured to apply a recording agent to a recording medium, wherein the recording agent develops metallic luster when fixed to the recording medium and the recording unit is configured to perform recording on both sides of the recording medium, the recording method comprising:

obtaining information related to one side of the recording medium and indicating an amount of the recording agent to be used in recording an image to be recorded on the one side and to obtain information related to the other side of the recording medium opposite from the one side, wherein the information related to the other side is about an amount of the recording agent to be used in recording an image to be recorded on the other side; and setting recording order, wherein, in a case where the amount of the recording agent indicated by the obtained information related to the one side is greater than the amount of the recording agent indicated by the obtained information related to the other side and a difference between the amount of the recording agent indicated by the information related to the one side and the amount of the recording agent indicated by the information related to the other side is equal to or larger than a predetermined amount, setting includes setting the recording order so that, after the image to be recorded on the other side is recorded on a first side of the recording medium, the image to be recorded on the one side is recorded on a second side of the recording medium opposite from the first side, wherein, in the case where the amount of the recording agent indicated by the obtained information related to the one side is not greater than the amount of the recording agent indicated by the information related to the other side and the difference between the amount of the recording agent indicated by the information related to the one side and the amount of the recording agent indicated by the information related to the other side is equal to or larger than the predetermined amount, setting includes setting the recording order so that, after the image to be recorded on the one side is recorded on the first side, the image to be recorded on the other side is recorded on the second side, and wherein, in a case where the difference between the amount of the recording agent indicated by the information related to the one side and the amount of the recording agent indicated by the information related to the other side is less than the predetermined amount, setting includes setting the recording order so that, after the image to be recorded on the one side is recorded on the first side, the image to be recorded on the other side is recorded on the second side.

14. The recording method according to claim 13, wherein the information related to the one side and the information related to the other side are information indicating total amounts of the recording agent to be used in recording the image to be recorded on the one side and the image to be recorded on the other side on the recording medium.

15. The recording method according to claim 13, wherein the recording unit is configured to apply a color recording agent including a color material to the recording medium, and wherein the information related to the one side and the information related to the other side are information indicating amounts of the recording agent to be formed in an exposed state at a surface when the image to be recorded on the one side and the image to be recorded on the other side are recorded on the recording medium.

16. The recording method according to claim 13, further comprising a conveyance unit configured to come into contact with the recording medium and convey the recording medium, wherein the information related to the one side and the information related to the other side are information indicating amounts of the recording agent to be applied to a region of the recording medium, and wherein the region of the recording medium comes into contact with the conveyance unit when the recording medium is conveyed by the conveyance unit.

17. A recording apparatus comprising:

a recording unit configured to apply a recording agent to a recording medium, wherein the recording agent develops metallic luster when fixed to the recording medium and the recording unit is configured to perform recording on both sides of the recording medium;

an obtaining unit configured to obtain information related to one side of the recording medium and indicating an amount of the recording agent to be used in recording an image to be recorded on the one side and to obtain information related to the other side of the recording medium opposite from the one side, wherein the information related to the other side is about an amount of the recording agent to be used in recording an image to be recorded on the other side;

a setting unit configured to set recording order;

a storage unit configured to receive, from an external apparatus, data on the image to be recorded on the one side and the image to be recorded on the other side on the recording medium, and to store the data, wherein the received data has recording order; and a notification control unit;

wherein, in a case where the amount of the recording agent indicated by the obtained information related to the one side is greater than the amount of the recording agent indicated by the obtained information related to the other side, the setting unit sets the recording order so that, after the image to be recorded on the other side is recorded on a first side of the recording medium, the image to be recorded on the one side is recorded on a second side of the recording medium opposite from the first side, wherein, in the case where the amount of the recording agent indicated by the obtained information related to the one side is not greater than the amount of the recording agent indicated by the information related to the other side, the setting unit sets the recording order so that, after the image to be recorded on the one side is recorded on the first side, the image to be recorded on the other side is recorded on the second side, and wherein, in a case where recording order of the data set by the setting unit is different from the recording order of the data received by the storage unit, the notification control unit causes a notification unit to notify a user that the recording order is changed.

18. The recording apparatus according to claim 1, wherein the information related to the one side and the information related to the other side are information indicating total amounts of the recording agent to be used in recording the image to be recorded on the one side and the image to be recorded on the other side on the recording medium.

19. The recording apparatus according to claim 1, wherein the recording unit is configured to apply a color recording agent including a color material to the recording medium, and wherein the information related to the one side and the information related to the other side are information indicating amounts of the recording agent to be formed in an exposed state at a surface when the image to be recorded on the one side and the image to be recorded on the other side are recorded on the recording medium.

* * * * *